United States Patent [19]

Goldsworthy et al.

[11] 3,966,533

[45] June 29, 1976

[54] ON-SITE WALL STRUCTURE FORMATION

[75] Inventors: William Brandt Goldsworthy, Palos Verdes; Ethridge E. Hardesty, Pine Valley, both of Calif.

[73] Assignee: Goldsworthy Engineering, Inc., Torrance, Calif.

[22] Filed: Sept. 19, 1973

[21] Appl. No.: 398,755

Related U.S. Application Data

[63] Continuation-in-part of Ser. No. 352,413, April 19, 1973, abandoned.

[52] U.S. Cl. ..... 156/380; 52/749; 156/446; 156/500; 264/32; 425/60

[51] Int. Cl.[2] ..... B32B 19/02

[58] Field of Search ..... 156/380, 500, 425, 501, 156/429, 535, 433, 543, 391, 431, 427, 459, 430; 52/245, 249, 247, 749, DIG. 7; 214/1 H; 425/DIG. 16, 16, 60, 64; 242/7.21, 7.22; 264/32, 35

[56] References Cited

UNITED STATES PATENTS

| | | | |
|---|---|---|---|
| 2,339,892 | 1/1944 | Urschel | 425/60 |
| 2,871,911 | 2/1959 | Goldsworthy et al. | 156/380 |
| 2,877,530 | 3/1959 | Winn, Jr. | 52/749 |
| 3,337,384 | 8/1967 | Wright | 156/425 |
| 3,507,735 | 4/1970 | Chisholm | 156/380 |
| 3,616,070 | 10/1971 | Lemelson | 156/446 |
| 3,652,366 | 3/1972 | Carlini | 156/429 |
| 3,661,491 | 5/1972 | Troyer | 425/517 |

*Primary Examiner*—William A. Powell
*Assistant Examiner*—J. J. Gallagher
*Attorney, Agent, or Firm*—Robert J. Schaap

[57] ABSTRACT

An apparatus and a method for fabricating on-site storage structures with reinforced composite materials, as well as the storage structures produced in accordance with the apparatus and method. In one aspect of the invention, reinforcing material which comprises at least one layer of fiber containing strand material, and one or more layers of fiber containing mat material are resin impregnated and passed through a draw-die orifice. Upon passing through the draw-die orifice this material is deposited in a continuously formed spiral where the turns forming the spiral are registered with each other. A cure of the resin material is initiated as the impregnated reinforcing material passes through the draw-die orifice. The cure is initiated by means of a curing device which applies dielectric energy to the impregnated reinforcing material, to thereby form a rigid spiral turn which becomes bonded to the next adjacent registered layer. In another aspect of the present invention, matrix impregnated reinforcing material is pultruded through a draw-die orifice and cured during the formation thereof as a continuous strip. This strip has the overall cross sectional shape and size of a turn in the storage structure and is coiled and retained in a dispensing container. This strip is then dispensed from the dispensing container and passed through an application head which deposits the strip in the form of a turn on a previously deposited turn and rigidly secures and bonds this turn to such previously deposited turn.

26 Claims, 40 Drawing Figures

ON-SITE WALL STRUCTURE FORMATION

The invention herein described was made in the course of or under a contract or subcontract thereunder with the Department of the Army of the United States.

RELATED DATA

This application is a continuation-in-part of our copending patent application, Ser. No. 352,413, filed Apr. 19, 1973 now abandoned for "On Site Wall Structure Formation".

BACKGROUND OF THE INVENTION

This invention relates in general to certain new and useful improvements in walled enclosures, and more particularly, to the formation of walled enclosures at a site of utilization.

Relatively large storage vessels and similar enclosures, such as grain silos, oil and gas tanks, and other large storage vessels must be constructed or otherwise fabricated at a site of utilization. Due to their large and bulky size, and substantially heavy weight, vessels of this type cannot be readily constructed in a factory and transported to a site of use.

There have been many proposals and indeed, some undertakings to construct components of a large storage vessel, such as side wall segments, in a factory and thereafter assemble these components at the site of utilization. However, most of these storage vessels must be liquid-tight and in many cases gas-tight, and if the various components are not properly mated with a highly critical tolerance, then these objects cannot be fulfilled. Consequently, fabrication of mating components in a factory with an on-site assembly of the components to form a large storage vessel, has not proved to be very satisfactory, and has also been found to be quite costly.

As a result of the deficiencies in constructing a storage vessel from mating component parts, most storage vessels have been erected in a field or other site of utilization. Most of these storage tanks or other storage vessels are made of steel or other heavy structural metals and this, of course, requires a transport of the sheet metal and other materials which are used in the fabrication of the tank to the construction site. Furthermore, erecting equipment, welding equipment, and other forms of metal fabrication and metal working equipment must also be transported to the construction site. Thus, a very substantial portion of the cost of erecting a large metal storage vessel resides in the labor of material handling and the assembly and disassembly of the erecting equipment and supporting structures.

Notwithstanding the substantially high cost in erecting a metal storage structure, these structures inherently suffer from several disadvantages which seriously limit their use. If the storage vessel is designed to contain a corrosive liquid or other corrosive contents, the vessel must be properly lined with glass or other corrosive resistant materials which again substantially increases the cost of the vessel. Furthermore, due to the very significant weight of the steel and other structural metals which are used in the fabrication of metal storage vessels, a fairly substantial foundation or base must be applied to the ground or other supporting surface for erecting the storage vessel. In addition, these metal storage vessels are usually subject to a fair amount of maintenance which increases the operating costs thereof.

In order to overcome the problems inherent with the fabrication and use of metal storage vessels, there have been several attempts to fabricate storage vessels from fiber reinforced materials, such as fiberglass, or from other forms of plastic materials. One such proposal is described in U.S. Pat. No. 3,337,384, which relies upon a system for fabricating wall structures formed of an expandable polystyrene material. In this case, expandable polystyrene is applied in the form of a continuous spiral strip to form a vessel wall. This form of system suffers many disadvantages including a relatively low strength. Consequently, the overall size of the vessel which can be produced in accordance with this system is very limited.

Another proposal for forming a non-metallic tank at an on-site location is taught in U.S. Pat. No. 2,729,268, which relies upon the winding of a storage vessel with resin impregnated fiber material, in a manner very similar to the formation of continuous tubes such as pipe and the like. Again, by the very nature of the device taught, the overall size of the vessel is limited and furthermore, a very substantial amount of fiber containing strand material must be employed which very substantially increases the overall cost of the vessel.

A further method of forming a fiber containing reinforced plastic tank is disclosed in U.S. Pat. No. 2,808,097, which also employs a rotating mandrel to generate a series of vertically superimposed cylindrical rings. This system is extremely complex and requires a substantial amount of manual labor, and thereby materially increases the cost of erecting the vessel.

It is therefore the primary object of the present invention to provide a method and apparatus for fabricating storage vessels from fiber containing reinforcing materials which substantially reduces material handling and labor requirements in assembling the storage vessel.

It is another object of the present invention to provide an improved apparatus and method of the type stated which lends to a very economical construction of on-site storage vessels.

It is a further object of the present invention to provide a method and apparatus of the type stated which permits the fabrication and construction of relatively large storage vessels at a site of utilization and which are capable of containing substantial amounts of and a wide variety of stored materials.

It is an additional object of the present invention to provide a storage vessel which is fabricated from reinforced plastic materials, and which is relatively light in weight, when compared to similar metal structures, but which is, nevertheless very durable and sturdy, requiring little, if any, subsequent maintenance.

It is yet another salient object of the present invention to provide a storage vessel of the type stated which can be fabricated with the same apparatus from a wide variety of reinforced plastic material compositions in order to provide the desired material storage characteristics.

With the above and other objects in view, our invention resides in the novel features of form, construction, arrangement and combination of parts presently described and pointed out in the claims.

GENERAL DESCRIPTION

Generally speaking, the present invention relates to an apparatus for generating a walled enclosure, preferably in the form of a cylindrical storage structure from successive turns of spirally wound reinforcing material. The present invention also provides a method for making these walled enclosures as well as the reinforced composite storage tanks which are uniquely constructed pursuant to the apparatus and the method herein. In the present disclosure the walled enclosure is sometimes hereinafter referred to as a storage tank or storage vessel or the like. However, the present invention is generic to the concept of making a walled enclosure.

The apparatus for generating the walled enclosure can generally be described as comprising a supporting member which is rotatable through a cylindrical path. An application head is carried by this supporting member and is movable in a cylindrical path, having a peripheral length equivalent to the peripheral length of the walled enclosure to be formed. Means are provided to supply the fiber containing reinforcing material, which has been previously impregnated with a matrix material, to the application head. This application head includes a cavity which is located to receive the matrix impregnated reinforcing material. In this way, the application head permits deposition of the material on a previously deposited turn of the spirally wound reinforcing material. Consequently, successive turns of the continuously deposited reinforcing material in the form of a spiral, will generate the walled enclosure, which is preferably cylindrical in construction. Application means are preferably carried by this application head to rigidly secure and bond the impregnated reinforcing material during the deposition thereof as a new turn of the walled enclosure to a previously deposited turn of the reinforcing material in the walled enclosure.

The apparatus of the present invention can be described in further detail in that in one embodiment of the apparatus, the supporting member is a boom, which is rotatable about a fixed axis approximating the center of the walled enclosure. In another embodiment of the present invention, the supporting member is an upstanding supporting shaft which moves around the successive turns of spirally wound reinforcing material. This supporting member will move in a path having a peripheral length approximately equal to or slightly greater than the peripheral length of the walled enclosure which is to be formed. In each case this supporting member will carry the application head.

In the first named embodiment of the apparatus, this apparatus will comprise a rotatable base plate which is located within the circumferential periphery of the walled enclosure to be formed. In this case, the supporting member is also a boom and is rotatable with the base plate about the fixed axis approximating the center of the walled enclosure. In this aspect of the invention, an impregnating matrix material and the reinforcing material are located on and movable with the base plate as well. The impregnating material is located to be contacted by the reinforcing material so that the matrix material is thoroughly impregnated into the reinforcing material prior to introduction into the application head. In addition, a motive means is operatively associated with the base plate for rotating this base plate, and additional motive means are carried by the application head for moving the same along the successive turns of the previously deposited spirally wound reinforcing material.

In the second mentioned embodiment of the apparatus of the present invention, the apparatus comprises a movable carriage member which is preferably self powered, and is rotatable about the circumferential periphery of the walled enclosure to be formed. This supporting member is again an upstanding supporting shaft which is carried by and movable with the carriage member. In this case, the reinforcing material and the impregnating material are movable with the carriage member. In like manner, the impregnating matrix material is located to be contacted by the reinforcing material prior to introduction into the application head.

The invention is operable in two modes to bond a turn to a previously deposited turn in the walled enclosure. In one mode a primary bonding is achieved where the impregnated reinforcing material is formed and cured in-situ as a turn in the walled enclosure. In the other mode a secondary bonding is achieved where the turn is fully cured and mechanically attached to and preferably chemically bonded to the previously deposited turn in the walled enclosure.

In the first mode of operation the cavity in the application head is a draw-die forming orifice which receives matrix impregnated reinforcing material which is uncured and forms the reinforcing material in a desired shape and deposits same as a turn on a previously deposited turn of the spirally wound reinforcing material. In this case the application means includes a curing means for applying a curing radiation to the matrix impregnated reinforcing material during deposition thereof to form a cured and rigid turn of reinforcing material.

In the second mode of operation, the means to supply the matrix impregnated reinforcing material comprises a pultrusion device which pultrudes a substantially fully cured amount of the matrix impregnated reinforcing material having a cross sectional shape substantially equivalent to the shape of a turn in the walled enclosure. A canister is provided and sized so that the pultruded reinforcing material which is fully cured can be introduced into a canister and which canister is located within the area of the walled enclosure to dispense the fully cured reinforcing material to the application head.

In a preferred aspect of the present invention, a structural foundation member is formed in or otherwise provided for operative mounting to a support surface, and this structural foundation member is adapted to receive the turns of reinforcing material. The structural foundation member will have a cylindrical peripheral length substantially equivalent to the cylindrical peripheral length of the storage structure to be formed. Several aspects of this foundation member are discussed hereinafter in more detail.

Also in a preferred aspect of the present invention, the curing means mentioned above is adapted to apply a dielectric curing radiation to the impregnated reinforcing material. This dielectric radiation will generally comprise either radio frequency energy, preferably in a wave length of thirteen to one hundred megahertz, or microwave energy, preferably in a wave length of two thousand, five hundred to ten thousand megahertz. The curing means which is carried by the application head is located in close proximity to the draw-die orifice in order to initiate a cure of the impregnated reinforcing material during the time that the impregnated reinforcing material passes through the draw-die orifice or immediately thereafter. In this case, the impregnated reinforcing material is passed through the head support member, which is preferably a hollow tubular member, and is thereafter immediately introduced into the application head which is mounted on the upper end of the head supporting member. Furthermore, a motive means, preferably in the form of drive rollers, are mounted on the application head for driving this head along the perviously cured and deposited turns of reinforcing material. In like manner, additional motive means are provided for rotating the support member, either on the base plate or on the carriage mechanism as mentioned above, through the cylindrical path.

The apparatus for generating the walled enclosure and which utilizes primary bonding, can generally be described as comprising a supporting member which is rotatable through a cylindrical path. An application head is carried by this supporting member and is movable in a cylindrical path, having a peripheral length equivalent to the peripheral length of the walled enclosure to be formed. Means are provided to supply the fiber containing reinforcing matieral, which has been previously impregnated with a curable matrix material, to the application head. This application head includes a draw-die forming orifice which is located to receive the matrix impregnated reinforcing material. In this way, the draw-die orifice forms the material into a desired shape and permits deposition of the material on a previously deposited turn of the spirally wound reinforcing material. Consequently, successive turns of the continuously deposited reinforcing material in the form of a spiral, will generate the walled enclosure, which is preferably cylindrical in construction. A curing means is preferably carried by this application head to apply a curing radiation to the impregnated reinforcing material during deposition thereof, to thereby harden the reinforcing material in the form of a turn in the walled enclosure.

A system for fabricating a generally cylindrical storage structure and which utilizes secondary bonding can also be described in general terms as a means for forming a continuous length of substantially fully cured matrix impregnated fiber containing reinforcing material having a size and shape conforming to a layer turn in the storage structure. A storage means for retaining a coiled portion of the continous length of the substantially fully cured matrix impregnated reinforcing material is also provided. A head support member is rotatable through a cylindrical path, and has an end thereof rotatable through a cylindrical path length substantially equivalent to the cylindrical length of the storage structure to be formed. An application head is carried by and located on the last named end of the support member for receiving the matrix impregnated fiber containing reinforcing material from the storage means. A means is provided for moving the support member and application head along previously deposited turns of the reinforcing material and depositing the cured reinforcing material as a new turn on the last previously deposited turn of reinforcing material. As means on the application head bonds the new turn of matrix impregnated reinforcing material as a new layer turn to a previously deposited turn of reinforcing material.

This system described above can be further characterized in that the means which forms the continuous length of material comprises a means for impregnating a fiber containing reinforcing material with a curable matrix. Means is also provided for pulling the matrix impregnated reinforcig material through a draw-die orifice to provide a size and shape to the impregnated reinforcing material substantially equivalent to a layer turn in the storage structure. In addition means for substantially fully curing the reinforcing material pulled through the draw-die orifice is also provided.

The method of the present invention for generating the walled enclosure can be described in general terms as applying a foundation member to or otherwise forming a foundation member in the ground or other supporting surface. This foundation member again has a cylindrical length substantially equivalent to the cylindrical length of the walled enclosure, or storage structure to be formed. The method includes forming a matrix impregnated fiber containing reinforcing material with a size and shape conforming to a layer turn in the walled enclosure. The application head is moved in a cylindrical path of peripheral length substantially equivalent to the peripheral length of the walled enclosure to be formed. Thereafter, the impregnated reinforcing material is passed into and through the application head. This impregnated reinforcing material which has been shaped and sized is then applied to the previously deposited turn of spirally wound reinforcing material. During the passage of the impregnating reinforcing material through the appliction head, the reinforcing material in the form of a new turn is deposited on a previously deposited turn. This new turn is also bonded to the previously deposited turn of spirally wound reinforcing material.

The method of the present invention can be characterized in further detail in that a cavity is contained in the head through which the reinforcing material passes, and that this application head moves in a cylindrical path in substantial registry with the foundation member. Furthermore, the application head moves in a direction required to deposit reinforcing material. In like manner, the impregnated reinforcing material is passed through the tubular hollow head supporting member to the application head which is generally carried on the upper end of the head supporting member. In a preferred aspect of the method, an upper stiffening ring may also be attached to the upper margin of the walled enclosure thus formed.

The method of the present invention is also operable in both the primary bonding mode and the secondary bonding mode mentioned above. In the primary bonding mode the method can be further characterized in that the matrix impregnated reinforcing material is uncured and passes through a draw-die forming orifice in the application head which forms the reinforcing material in a desired shape and deposits the same as a turn on a previously deposited turn of the spirally wound reinforcing material. The method also includes applying a curing radiation to the matrix impregnated reinforcing material during deposition thereof to form a cured and rigid turn of reinforcing material.

In the secondary bonding mode of operation the matrix impregnated reinforcing material is formed with a desired cross sectional shape substantially equivalent to the shape of a turn in the walled enclosure. In one aspect of the invention the new turn of impregnated reinforcing material may be formed in a pultrusion device which pultrudes a substantially fully cured amount of the matrix impregnated reinforcing material. The pultruded reinforcing material which is fully cured, is then introduced into a canister and which canister is located within the area of the walled enclosure to dispense the fully cured reinforcing material to the application head.

The cylindrical storage structures which are fabricated in accordance with the method and apparatus of the present invention can be described in general terms as comprising turns or layers which are continuously and spirally deposited, and each of the turns comprises a resin matrix impregnated reinforcing material. Each of the turns are cured in the form of a rigid segment, and are bonded to the turn immediately therebeneath and to the turn which is subsequently applied immediately thereabove, and this bonding will form a liquid-tight sealing engagement between the various registered turns.

In further detail, the cylindrical storage structure can be characterized in that each one of the turns is formed with a tongue on one of the upper or lower margins thereof, and which lies in abutting engagement therewith. These turns are provided with a desired size and shape as a result of passing through the draw-die orifice prior to deposition thereof. In addition, each of the turns, in a preferred aspect of the present invention, comprises a layer of fiber containing strands, and a layer of fiber containing mat on each of the opposite sides of the layer of fiber containing strands. Furthermore, the turns will preferably be provided with resin-matrix rich inner and outer vertically disposed surfaces.

DRAWINGS

Having thus described the invention in general terms, reference will now be made to the accompanying drawings which illustrate practical embodiments of the present invention and in which:

Figure 16:
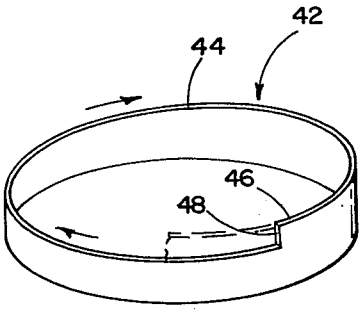
Figure 3:
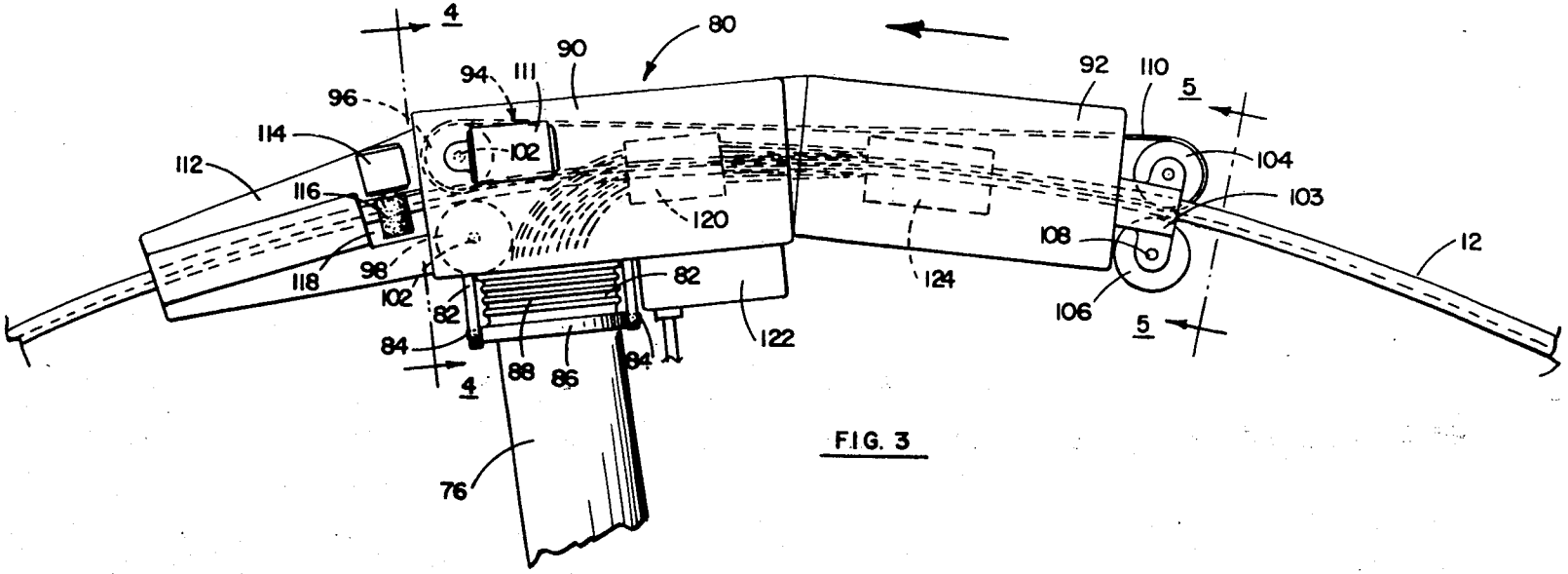
FIG. 3 is a perspective view, partially broken away and in section, and showing the material application head forming part of the apparatus of FIG. 1.
Figure 5:
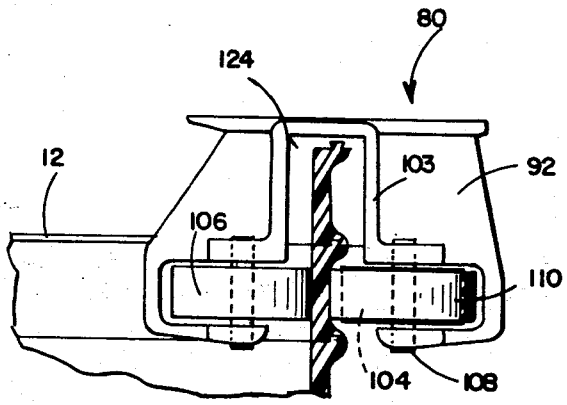
Figure 4:
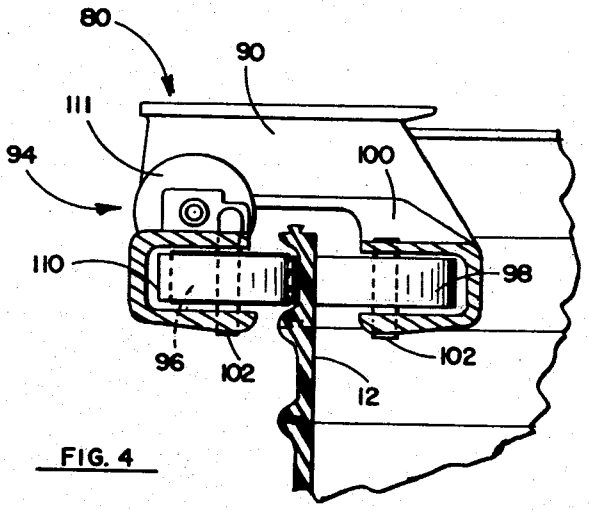
Figure 6:
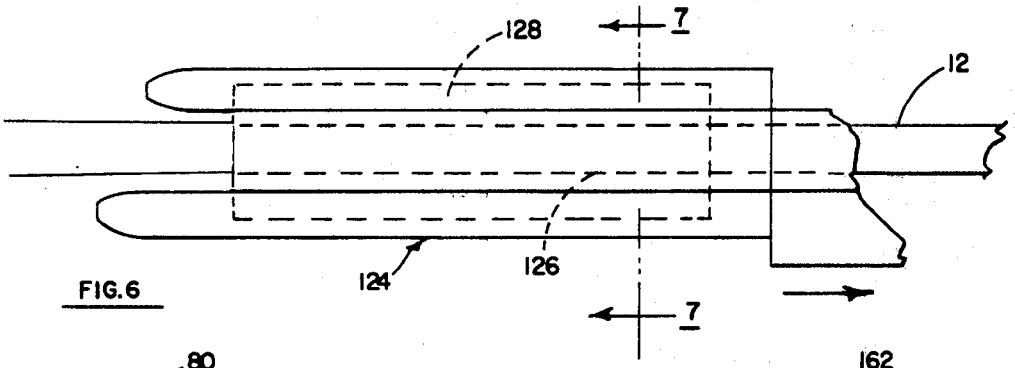
Figure 7:
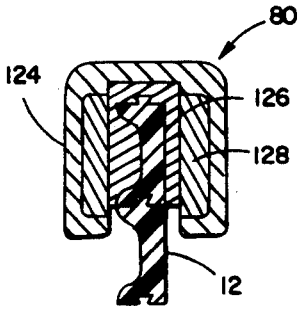
Figure 8:
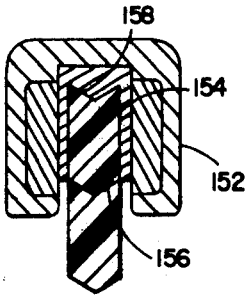
Figure 9:
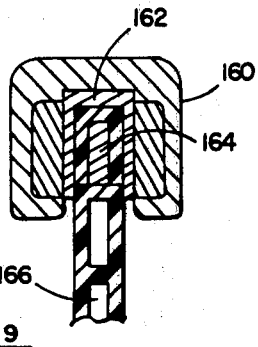
Figure 10:
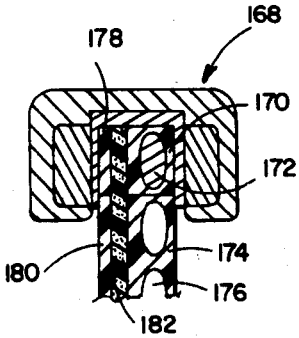
Figure 20:
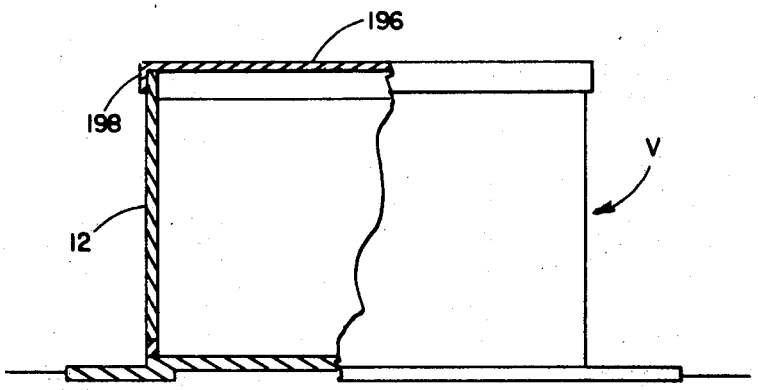
Figure 21:
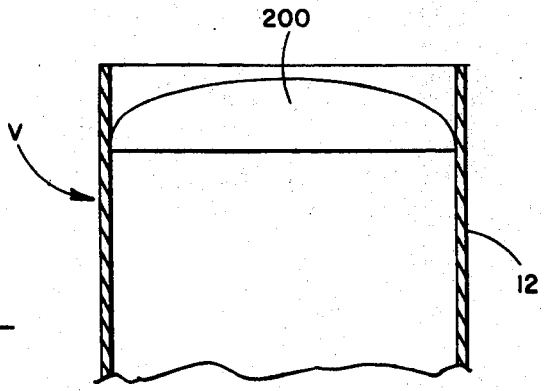
Figure 15A:
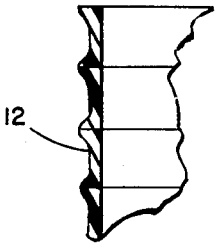
Figure 15B:
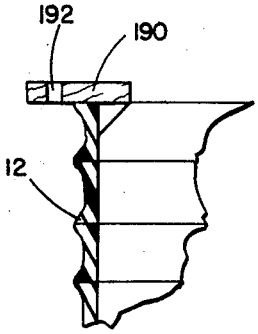
Figure 15C:
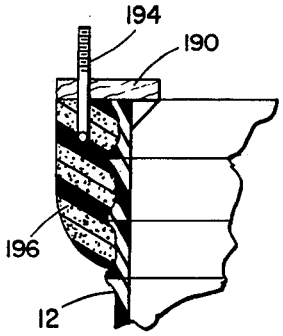
Figure 13A:
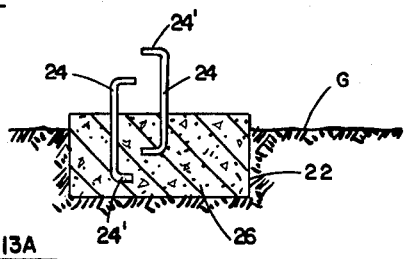
Figure 11:
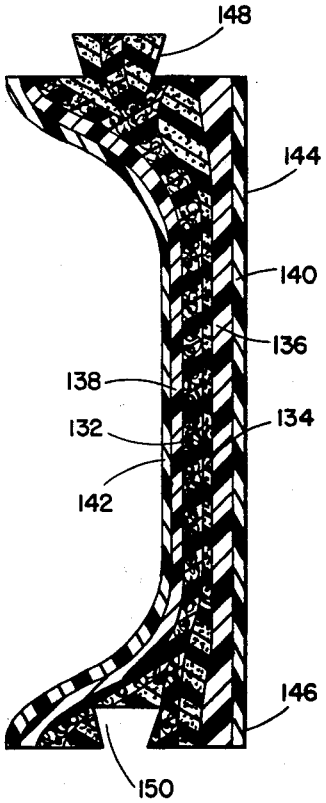
Figure 13B:
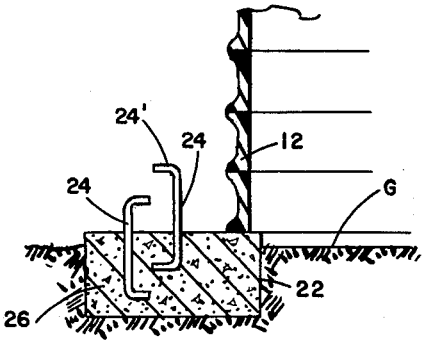
Figure 13C:
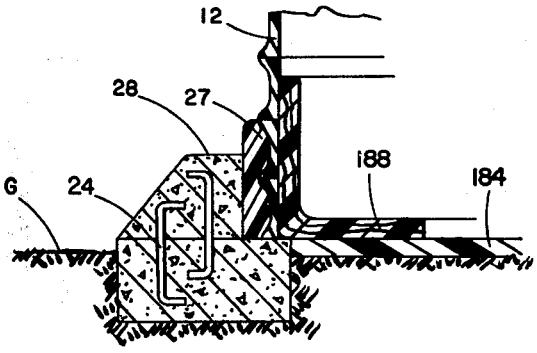
Figure 12A:
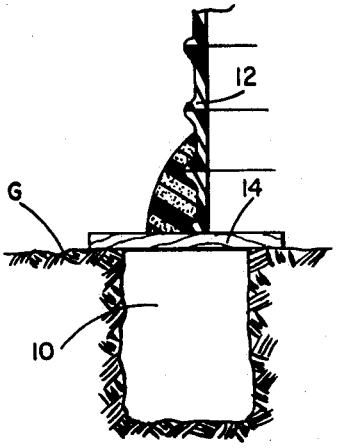
Figure 12B:
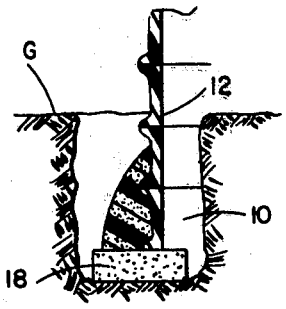
Figure 12C:
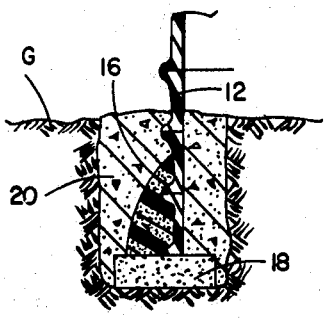
Figure 12D:
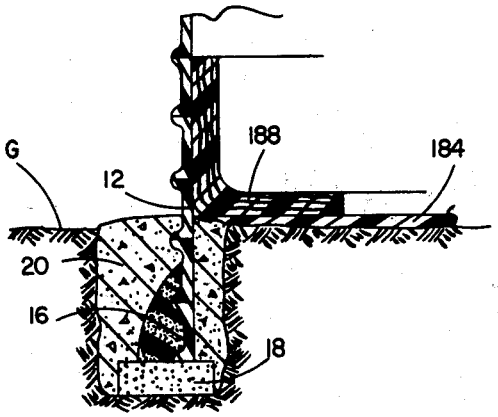
Figure 14A:
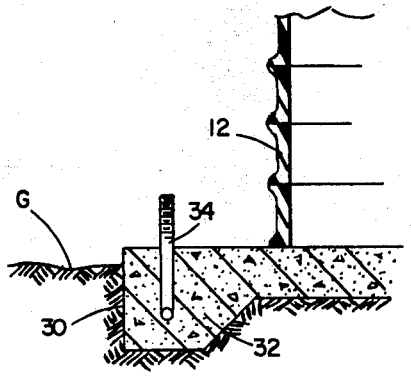
Figure 14B:
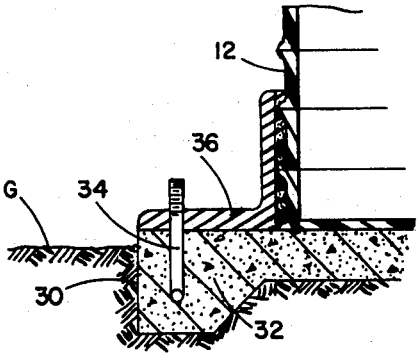
Figure 14C:
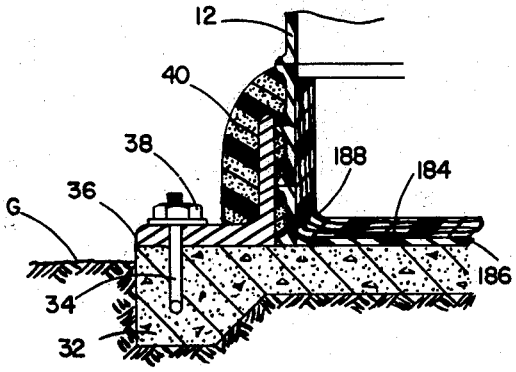
Figure 17:
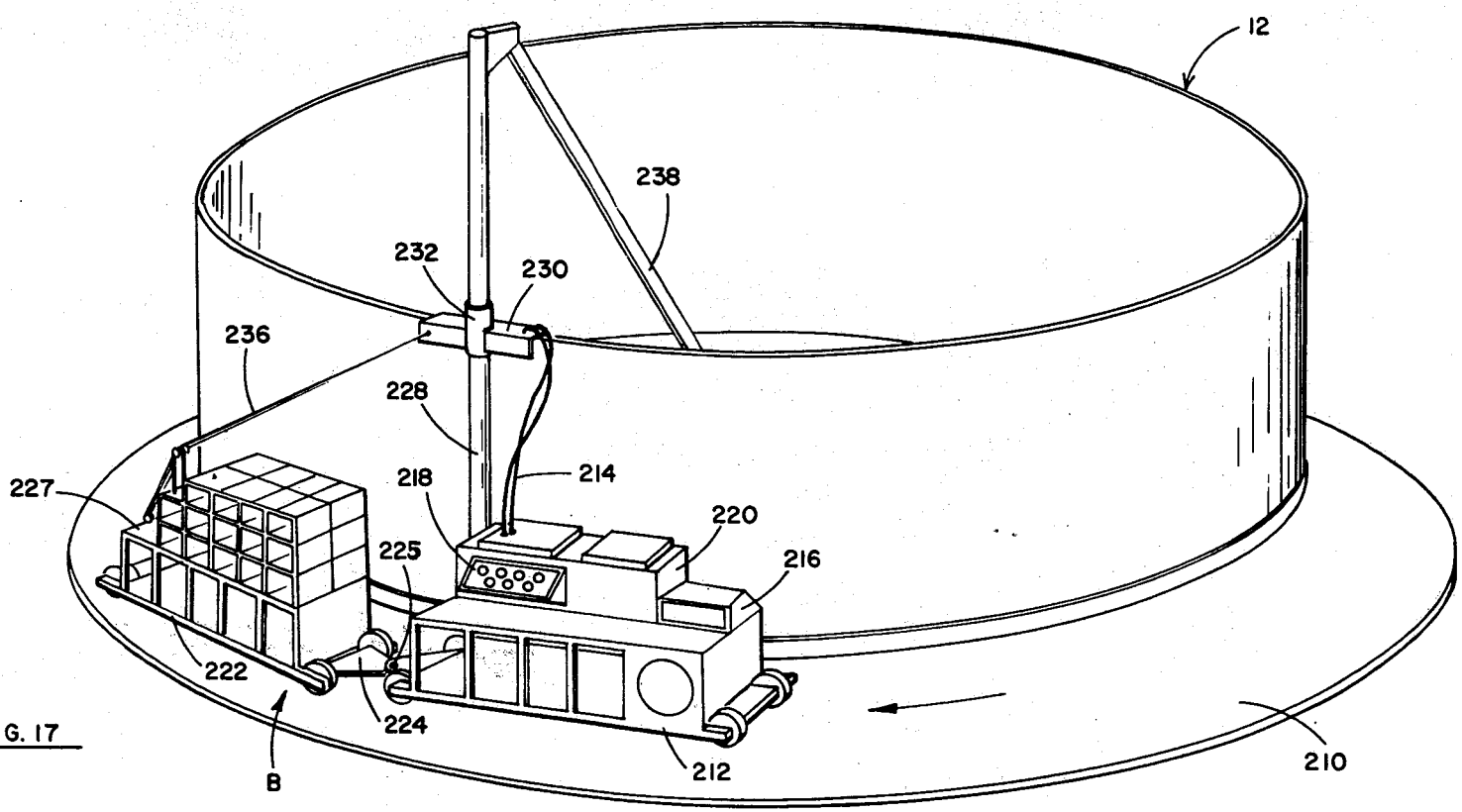
Figure 18:
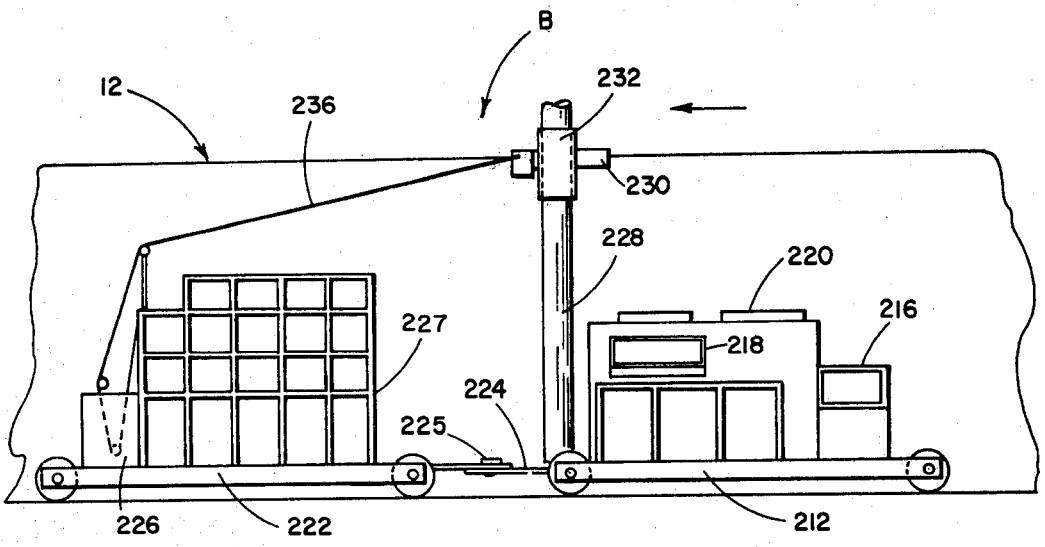
Figure 19:
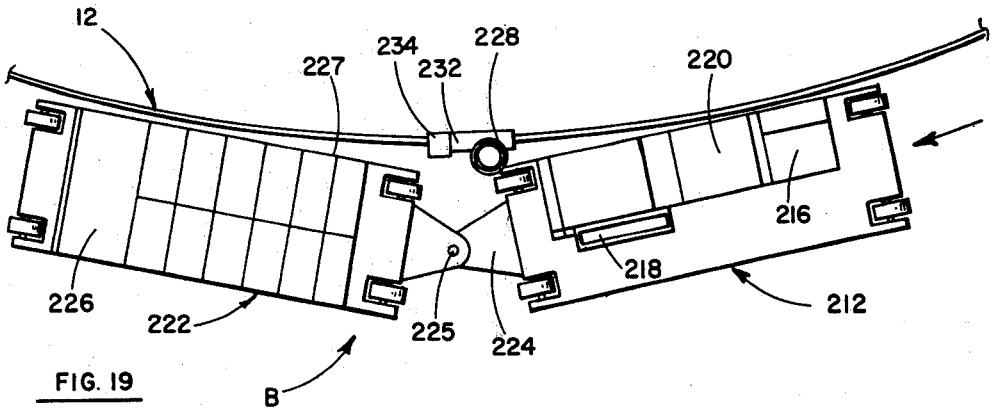
Figure 22:
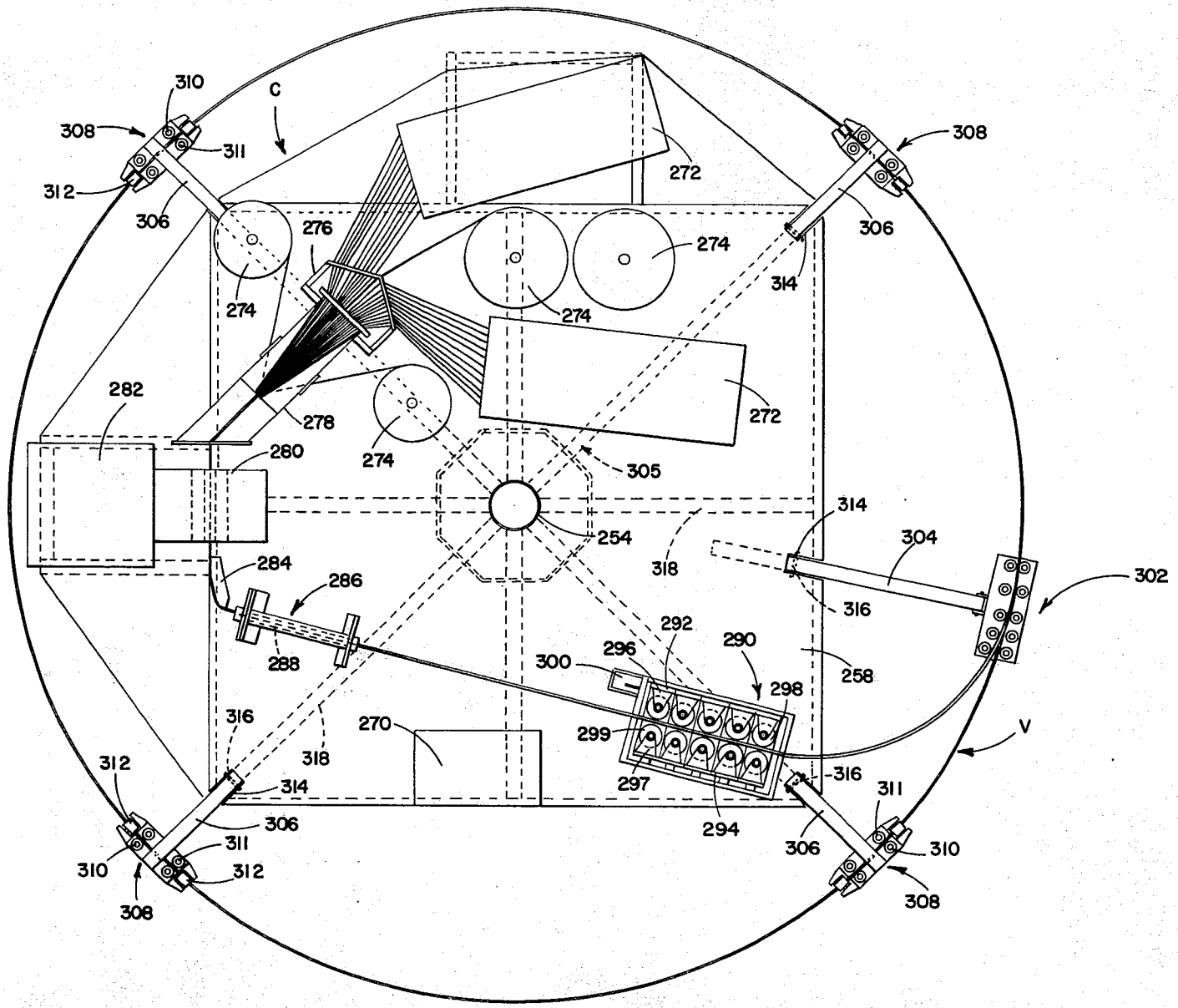
Figure 23:
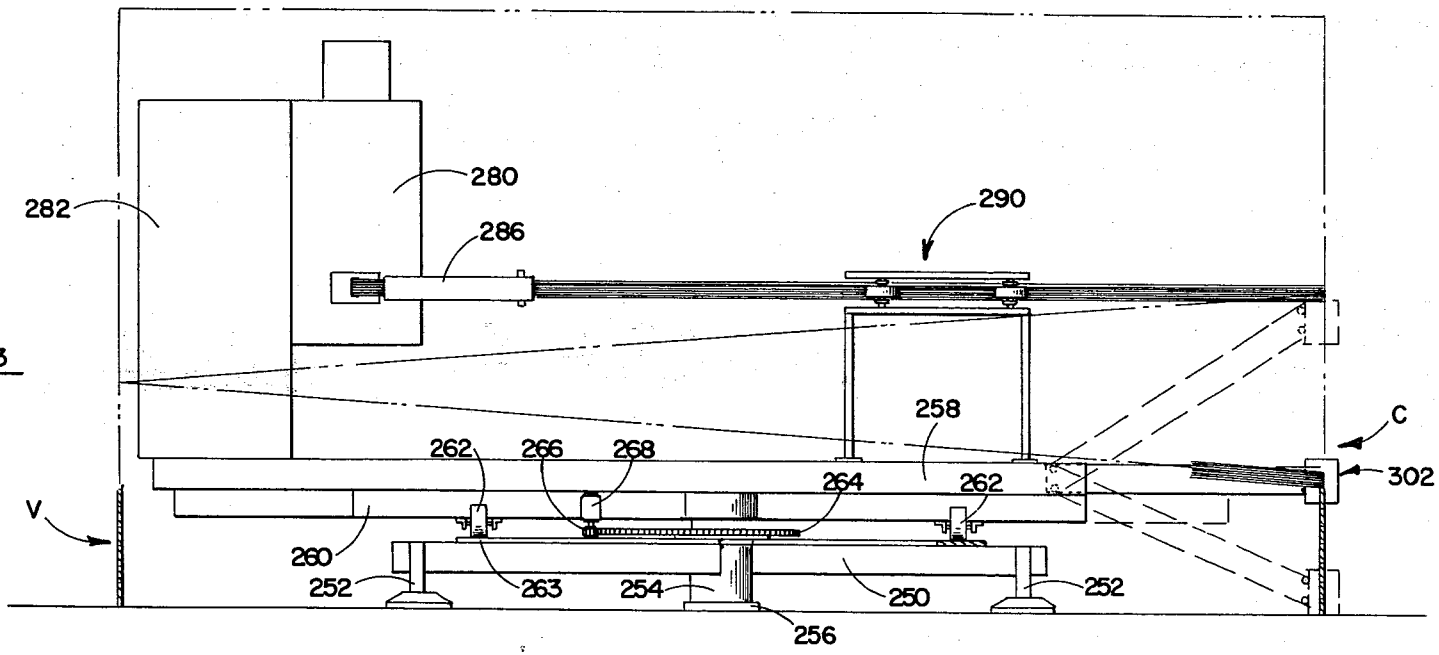
Figure 24:
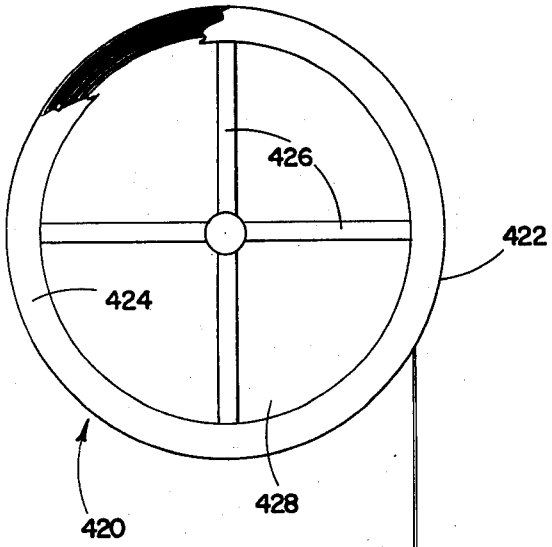
Figure 30:
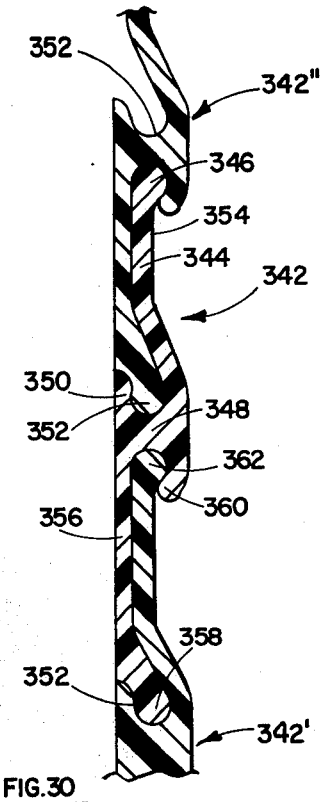
Figure 29:
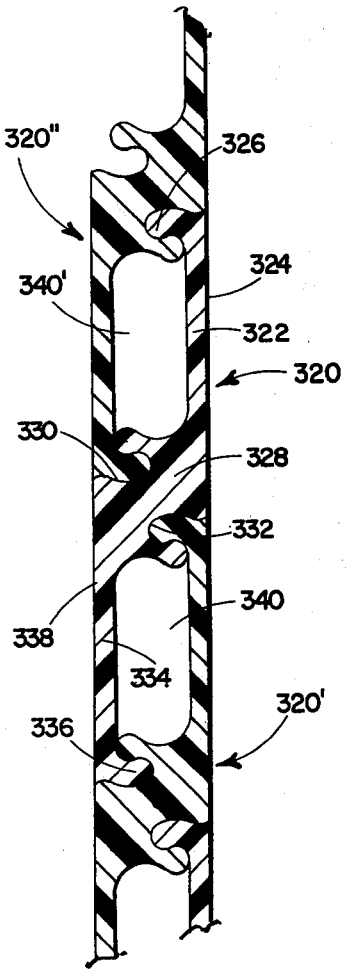
Figure 31:
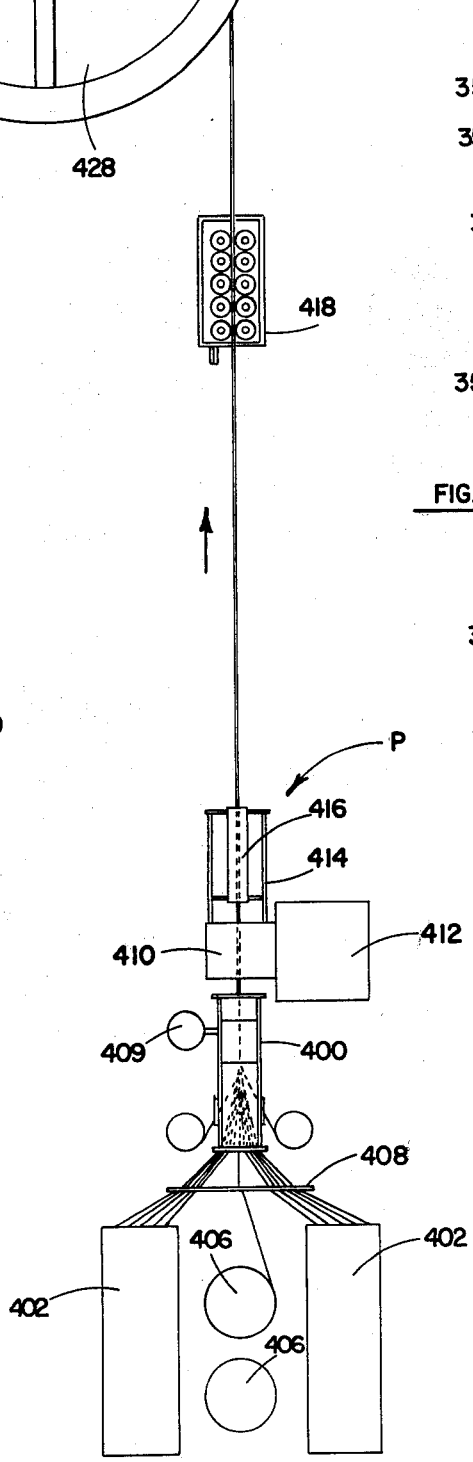
Figure 31:
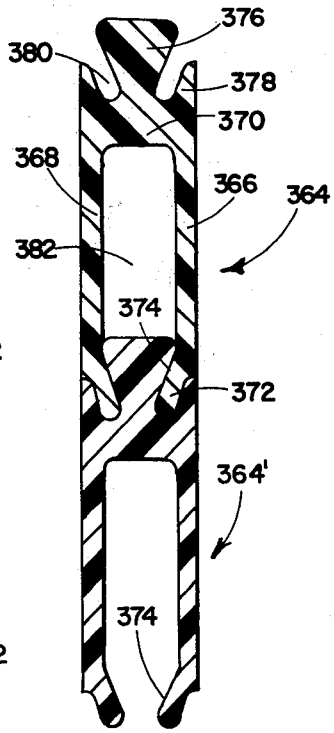
Figure 25:
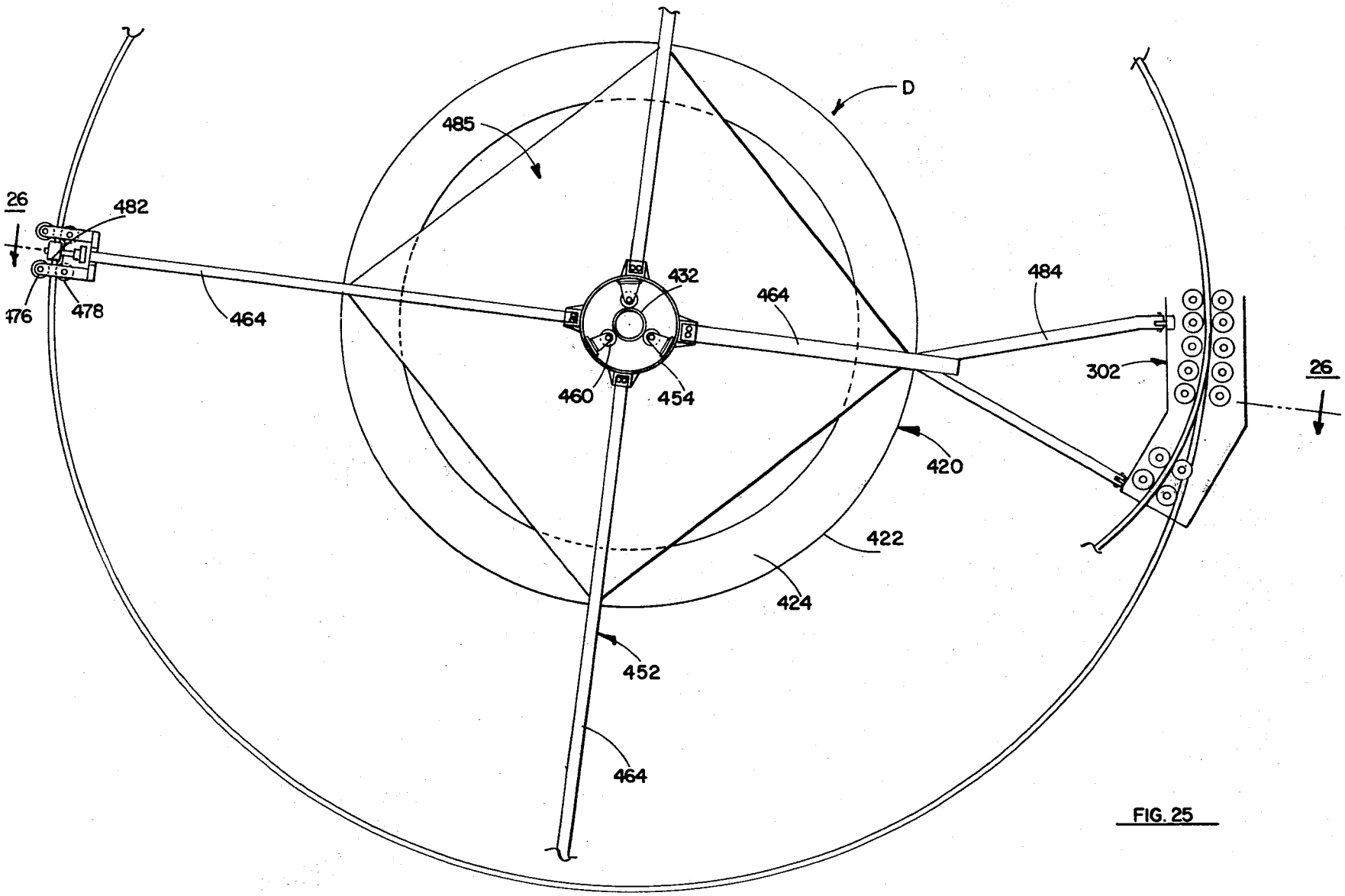
Figure 26:
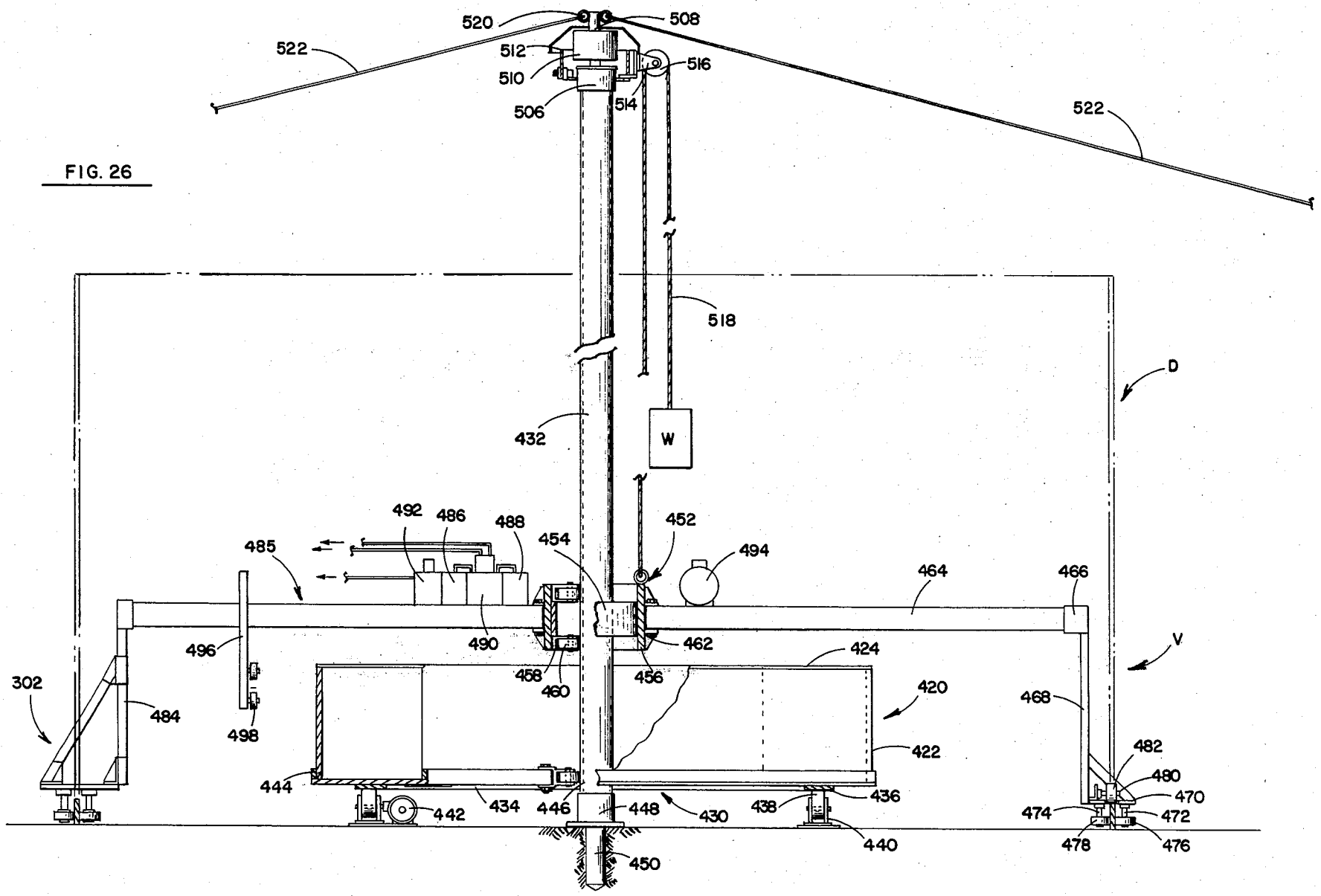
Figure 27:
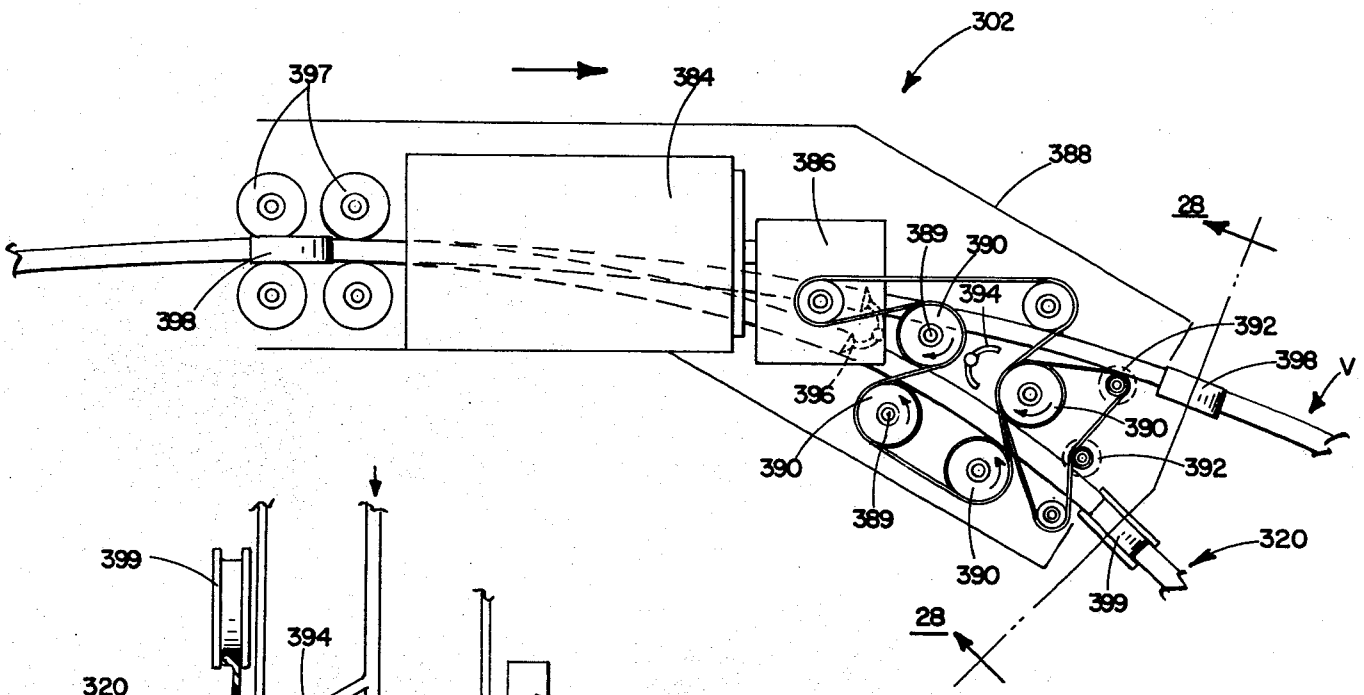
Figure 28:
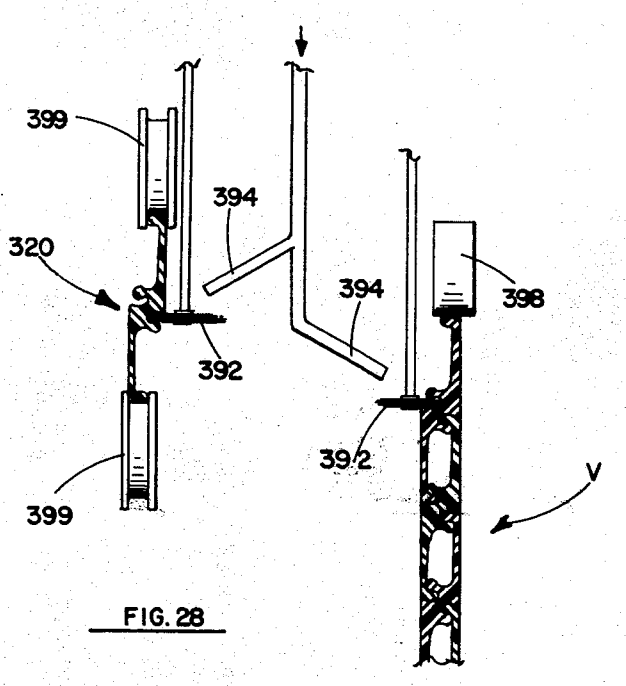

FIGS. 4 and 5 are horizontally sectional views taken alonge lines 4—4 and 5—5 respectively of FIG. 3;

FIG. 6 is a vertical sectional view taken through a portion of the material application head of FIG. 3, and showing a portion of the draw-die orifice in the material application head and the forming of the reinforcing material therein;

FIG. 7 is a vertical sectional view taken along line 7—7 of FIG. 6, and showing a modified form of a draw-die orifice and the forming of the reinforcing material in the draw-die orifice;

FIG. 8 is a vertical sectional view similar to FIG. 7, and showing another embodiment of a draw-die orifice and the forming of reinforcing material therein;

FIGS. 9 and 10 are vertical sectional views similar to FIG. 7, and showing still other embodiments of a draw-die orifice for forming the turns of the spiral wall in accordance with the present invention;

FIG. 11 is an enlarged vertical sectional view showing the various component layers in one turn of the spiral wall used in constructing a storage vessel in accordance with the present invention;

FIGS. 12*a* – 12*d* are a series of composite vertical sectional views showing one technique used in forming a foundation bed for the storage vessel of the present invention, and in which:

FIG. 12*a* is a vertical sectional view showing the formation of a ditch with the tank wall being generated on a ditch spreader;

FIG. 12*b* is a vertical sectional view, similar to FIG. 12*a*, and showing the tank wall lowered into the ditch and supported on a structural foundation member;

FIG. 12*c* is a vertical sectional view, similar to FIG. 12*b*, and showing a concrete footing poured into the ditch;

FIG. 12*d* is a vertical sectional view, similar to FIG. 12*c*, and showing the formation of a floor and wall/floor fillet;

FIGS. 13*a* – 13*c* are a series of composite vertical sectional views showing another technique for forming a foundation bed for supporting the tank wall in accordance with the present invention, and in which:

FIG. 13*a* is a vertical sectional view showing anchor bars mounted in a poured concrete footing;

FIG. 13*b* is a vertical sectional view, similar to the FIG. 13*a*, and showing the formation of the tank wall on the foundation bed of the concrete footing;

FIG. 13*c* is a vertical sectional view, similar to FIG. 13*b*, and showing the formation of a screeded curb around the tank wall thus formed;

FIGS. 14*a* – 14*c* are a series of composite vertical sectional views showing still another technique for forming a foundation bed in accordance with the present invention, and in which:

FIG. 14*a* is a vertical sectional view showing a concrete foundation floor with upstanding anchor bolts and the formation of the tank wall on this concrete foundation bed;

FIG. 14*b* is a vertical sectional view, similar to FIG. 14*a*, and showing the angle bar lugs which are mounted on the bolts and located against the tank wall;

FIG. 14*c* is a vertical sectional view, similar to FIG. 14*b*, and showing the mounting of lugs 36 with bolts and the formation of a skirt ring around the tank wall;

FIGS. 15*a* – 15*c* are a series of composite vertical sectional views showing the formation of an upper rim wall attachment, and in which:

FIG. 15*a* is a vertical sectional view showing the upper portion of the tank wall;

FIG. 15*b* is a vertical sectional view, similar to FIG. 15*a*, and showing a temporary wood ring attachment at the upper end of the tank wall;

FIG. 15*c* is a vertical sectional view, similar to FIG. 15*b*, and showing the filament wound stiffening ring and tank top attachment bolts formed at the upper end of the tank wall;

FIG. 16 is a perspective view of an additional starting ring used with the apparatus of the present invention in order to form the walled enclosure in accordance with the present invention;

FIG. 17 is a perspective view of another modified form of apparatus for generating a walled enclosure and constructed in accordance with and embodying the present invention;

FIG. 18 is a side elevational view of the apparatus of FIG. 17;

FIG. 19 is a top plan view of the apparatus of FIG. 17;

FIG. 20 is a vertical sectional view showing one form of walled enclosure which may be constructed in accordance with the present invention;

FIG. 21 is a vertical sectional view of another form of walled enclosure which may be constructed in accordance with the present invention;

FIG. 22 is a top plan view of a further modified form of apparatus for generating a walled enclosure and which is constructed in accordance with and embodies the present invention;

FIG. 23 is a side elevational view of the apparatus of FIG. 22;

FIG. 24 is a top plan view of a pultrusion device forming part of an additional modified form of apparatus for generating a walled enclosure, and which pultrusion device is used in the production of turns of reinforcing material included in the walled enclosure and introduces the turns of reinforcing material into a dispensing canister;

FIG. 25 is a top plan view of the additional modified form of apparatus for making a walled enclosure, and which utilizes the dispensing container of reinforcing material in FIG. 24;

FIG. 26 is a side elevational view, partially in section, of a portion of the apparatus of FIG. 25 and taken substantially along the plane of line 26—26 in FIG. 25;

FIG. 27 is a top plan view of an application head which is used in the apparatus of FIGS. 24 — 26;

FIG. 28 is a horizontal sectional view taken along line 28—28 of FIG. 27;

FIG. 29 is a vertical sectional view showing one form of turn construction which may be used in the generation of the walled enclosure in accordance with the present invention;

FIG. 30 is a vertical sectional view showing a modified form of turn construction which may be used in the generation of the walled enclosure in accordance with the present invention;

FIG. 31 is a vertical sectional view showing another modified form of turn construction which may be used in the generation of the walled enclosure in accordance with the present invention.

DETAILED DESCRIPTION

Referring now in more detail and by reference characters to the drawings which illustrate practical embodiments of the present invention, A designates an apparatus for constructing a storage vessel, designated generally as V. The vessel V is preferably fabricated on a foundation base which has been previously constructed upon the ground or other supporting surface G.

Prior to the actual generation of the tank side wall, it is necessary to prepare a proper foundation or so-called "tank footing". FIGS. 12-14 illustrate three forms of preparing the foundation or tank footing prior to the actual tank side wall generation. In accordance with the embodiment as illustrated in FIGS. 12*a* – 12*d*, a circular ditch 10 having a generally rectangular shape in vertical cross-section is formed on the ground or other supporting surface on which the tank side wall, designated by reference numeral 12, is to be fabricated. This ditch 10 will also have a circumferential length equivalent to the circumferential length of the tank wall 12 which is to be generated. A plurality of temporary ditch spreaders 14, in the form of planks or other supporting members are disposed over this temporary ditch 10 and the tank wall 12 is initially formed on the ditch spreaders 14.

An annular reinforcing ring 16 is formed by filament winding or otherwise depositing reinforced plastic material along the base portion of the tank wall 12 in the manner as illustrated in FIG. 12c. In this case, the reinforcing ring 16 may be conveniently formed by effectively pultruding reinforcing material from the application head in a manner to be hereinafter described. Concrete blocks or similar structural foundation members 18 are then disposed within the ditch to form a foundation bed. Thereafter, when the tank wall 12 with the reinforcing ring 16 has been completely formed, it can be suspended by means of a derrick or other supporting structure in order to remove the ditch spreaders. The tank wall 12 is then lowered onto the foundation bed formed of the concrete blocks 18, which is followed by the pouring of a concrete footing 20 into the ditch to fill up the remainder thereof. In this way, the tank wall 12 is rigidly retained within the ditch and is adequately supported on the foundation bed, and fixedly held therein by means of the poured concrete footing 20.

Another system for forming a foundation support or "tank footing" for the tank wall 12 is more fully illustrated in FIGS. 13*a* – 13*c*. This system of forming the foundation support is preferable when the tank wall is being fabricated on a compact earth or sand floor base. In this particular case, an annular ditch 22 which is also generally rectangular in vertical cross-section is similarly formed in the ground or supporting surface G. This ditch 22 will further have a circumferential length substantially equivalent to the circumferentially length of the tank wall 12 which is to be formed. Rod-like anchor bars 24 preferably formed of steel or other structural material are embedded in the ditch 22 by means of a poured concrete footing 26 or other form of construction material.

The anchor bars 24 are preferably C-shaped in the manner as illustrated in FIGS. 13*a* and 13*b*, and the vertically spaced and horizontally struck legs thereof 24' are spaced apart from each other in the manner as illustrated therein. Thereafter, a layer 27 of mastic or other sealing material is circumferentially disposed around the base of the tank wall 12 in the manner as illustrated in FIG. 13*c*. Finally, additional concrete or other reinforcing material is poured over a portion of the mastic material and the anchor bars 24 in order to form a screeded curb 28, in the manner as illustrated in FIG. 13*c*.

An additional system for forming a foundation or "tank footing" for the tank wall 12 is also more fully illustrated in FIGS. 14*a* – 14*c*. In this latter embodiment, an annular ditch 30, which is somewhat trapezoidal in vertical cross-section, is formed in the ground or other supporting surface G, and this ditch will also have a circumferential length substantially equivalent to the circumferential length of the tank wall which is to be formed. However, in this particular case, a concrete floor or foundation 32 is also initially poured before the formation of the tank wall. During the pouring of the concrete floor 32, anchor bolts 34 are inserted in the precured concrete floor to be rigidly held therein when the concrete has set.

After the concrete floor 32 has set, a plurality of angle bar lugs 36 which are of generally L-shaped construction, are placed against the tank wall and against the upwardly presented surface of the concrete floor 32, in the manner as illustrated in FIG. 14*b*. Thereafter, nuts 38 are secured to the anchor bolts and a filament wound skirt ring 40 is thereafter formed around the anchor bar lugs in the manner as illustrated in FIG. 14*c*.

Again, this filament wound skirt ring may be formed by filament winding or otherwise depositing reinforced plastic material along the base portion of the tank wall 12, in the manner as also illustrated in FIG. 14*c*. The filament reinforcing skirt ring 40 may be conveniently formed by effectively pultruding reinforcing material from the application head in a manner to be hereinafter described in more detail.

Although the above three described systems for forming the foundation or tank footing, are the preferred systems, it should be recognized that other systems for constructing the foundation could also be employed. Generally, the form of foundation which is employed and the technique used to construct the foundation will depend upon a variety of factors, including the nature of the ground or other supporting surface upon which the tank side wall is to be generated, the size of the overall vessel which is to be fabricated, the contents which are to be retained in the vessel, and like factors.

After the foundation has been properly formed, an initial starting ring, which has a circumferential length substantially equivalent to the circumferential length of the tank wall to be generated, is then disposed on the foundation bed. One such starting ring 42 is more fully illustrated in FIG. 16. This starting ring 42 may be initially constructed with reinforced plastic materials, or it could be cast from any structural metal such as steel or the like. The starting ring 42 is generally provided with a spirally shaped upwardly presenting receiving surface 44 integrally including a shoulder-forming step 46 which provides a vertically disposed flat abutment wall 48.

In this way, it can be observed that reinforcing material deposition can be initiated at the flat wall 8 on the receiving surface 44 so that the initial turn of the spirally wound material will start in a spiral formation. In this connection, it should be observed that the initial turn which is partially illustrated in dotted lines in FIG. 16 has an overall height which is substantially equivalent to the overall height of the step 46. Consequently, when the material has been deposited on the receiving surface 44, in the direction of movement of the arrow illustrated in FIG. 16, the turn of the spiral will end in another step substantially similar to the step 46. Consequently, continuous reinforcing material deposition in the successive turns will continuously generate the spiral formation of the wall. It should be observed that the abutment wall 48 on the starting ring is located so that winding will occur in a clockwise direction, in order to show that winding can be performed in either a clockwise or counter-clockwise direction. However, when using a starting ring to wind in a counter-clockwise direction, the abutment wall 48 will face in the opposite direction.

The starting ring 42 may be integrally formed with the foundation bed, or otherwise, it may be a completely separate component which is disposed upon and rigidly secured to the concrete bed. The starting ring will also serve as a wall-weight distribution foundation. In the case of a disc slab type starting ring, it may be initially coated with a layer of reinforced chopped strand mat and a curable resin matrix.

Figure 1:
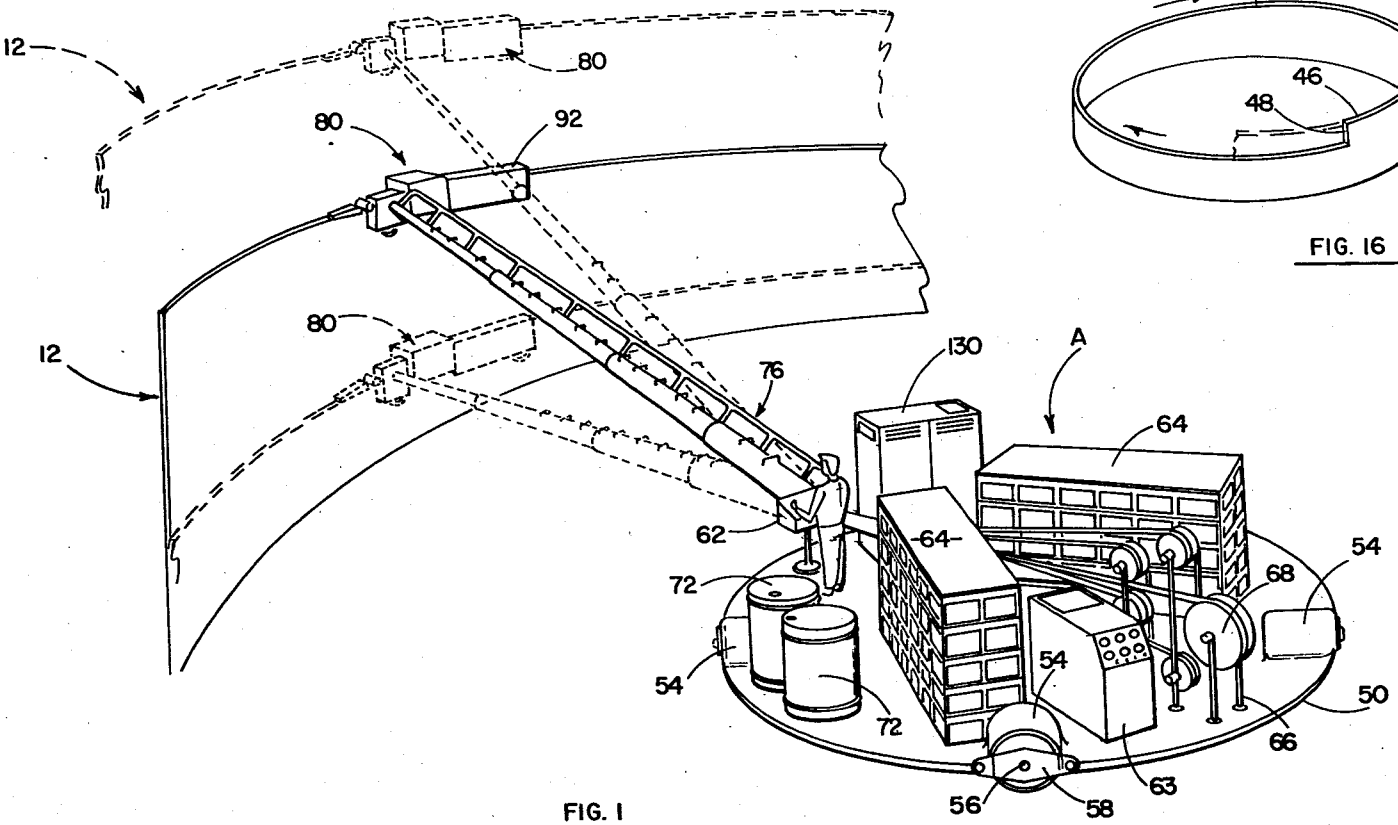
FIG. 1 is a perspective view, showing one embodiment of an apparatus for fabricating storage vessels in accordance with the present invention.
Figure 2:
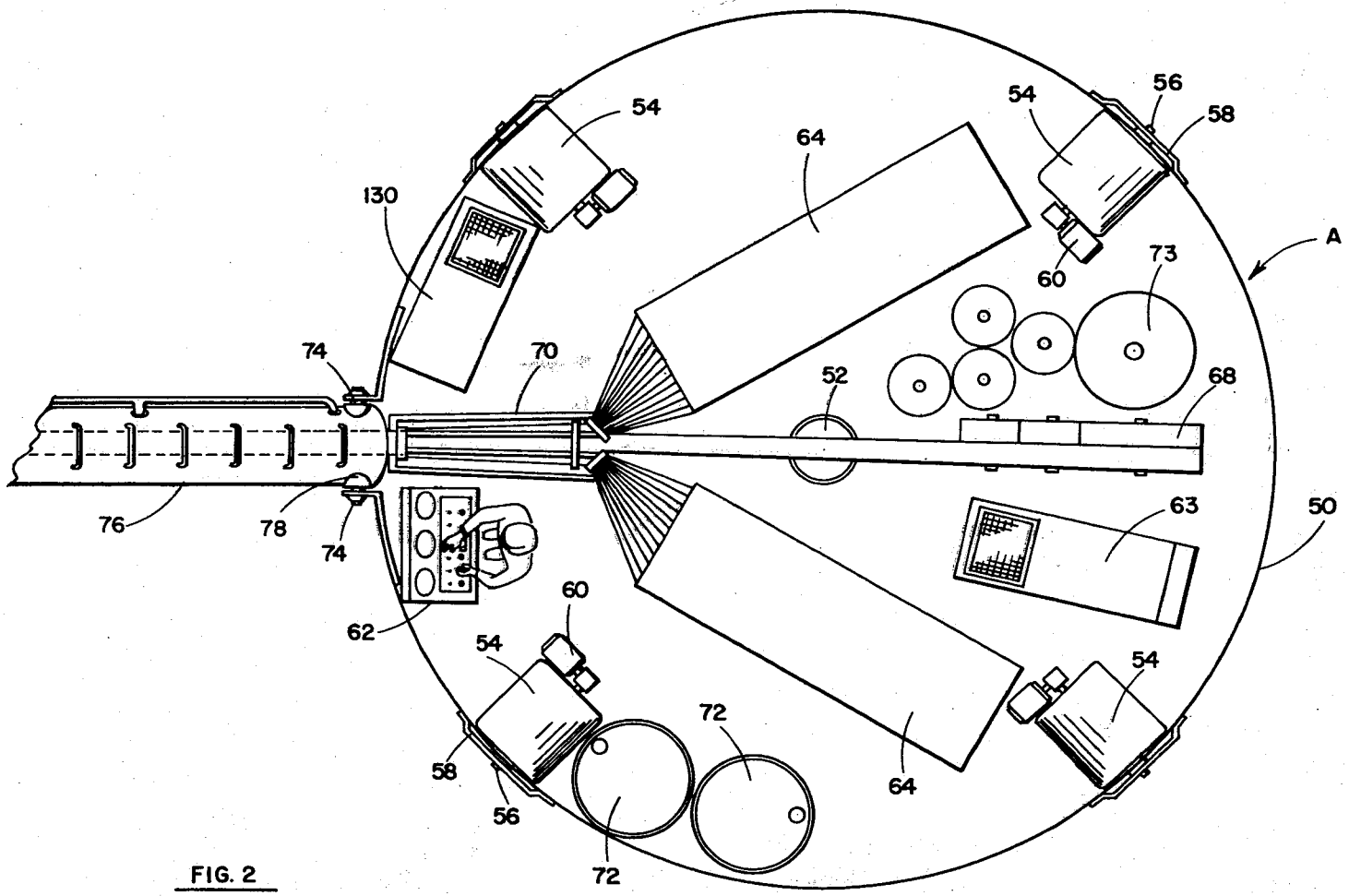
FIG. 2 is a top plan view of the apparatus of FIG. 1.

One embodiment of the apparatus for generating the spiral walled enclosure in accordance with the present invention is more fully illustrated in FIGS. 1–7. This apparatus A comprises a rotatable base plate 50 which is mounted for rotation about a stub king post 52. This stub king post 52 is preferably installed by mounting in the ground or other supporting surface G during the formation of the foundation bed, as previously described. This stub king post 52 will normally be located approximately in the geometric center of the foundation bed as illustrated in FIG. 2. The base plate 50 is provided with a plurality of drive rollers 54 which are operable to drive the base plate 50 about the king post 52. These rollers 54 are maintained by axles 56 mounted on brackets 58 and are suitably powered by individual electric induction motors 60. However, it should be observed that other forms of drive means and other power sources could be employed in accordance with the present invention. These motors 60 and hence the various drive wheels 54 are operated in unison from a central source such as an operator's control panel 62 also mounted on the base plate 50, in the manner as illustrated in FIGS. 1 and 2. An engine driven generator 63 may also be located on the base plate 52 in order to provide a source of power.

This base plate 52 is designed to accommodate all of the various components needed to provide the resin impregnated filament reinforcing material. Thus, referring again to FIGS. 1 and 2, it can be observed that storage racks or storage creels 64 are located on the base plate 50, and are designed to hold spools or rolls of filament containing strands or tapes. These spools are rotatably mounted on the creels 64 so that strand or tape material may be removed therefrom upon demand. In like manner, frames or racks 66 are also suitably mounted on the base plate 50 for rotatably supporting rolls or spools 68 of reinforcing mat material or like reinforcing material. These racks may be constructed as alternate feed racks to provide various forms of web or mat material. Thus, various forms of web or mat material may be simultaneously or alternately fed from these racks 66, such as slit rolls of wet material, spiral mat material, surfacing mat material, woven rovings, or the like. The mat material which is removed from the various storage racks 64, and the strand material which is removed from the spools 68 are then introduced into a resin impregnating mechanism 70 in the manner as illustrated in FIG. 2.

It can also be observed that the base plate 50 is designed with a suitable overall size to accommodate an inventory of needed materials, such as resin containers 72 or spare rolls of web or mat material 73. Thus, it can be observed that the base plate 50 with the components located thereon constitute a self operating unit for enabling an accumulation of the proper amounts and sources of reinforcing material for ultimate formation into a spiral ring.

The resin inpregnating member 70 may be any suitable type of resin impregnator, such as a dip tank which merely contains a liquid resin material. In this case, the mat or web material and the strand material are passed into the dip tank during movement to a tether boom (to be hereinafter described) for resin impregnation of the fibrous elements in these strand and mat materials. Otherwise, a resin impregnating canister could also be employed in which the resin material is forceably impregnated into the mat or web material and strand material.

Any of a number of commercially available resin matrix compositions can be used for impregnating the reinforcing materials such as the strand or mat material. The matrix should be capable at some stage of the process, of being liquefied and softened for a period of time, and also should be sufficient to flow around the filaments forming the strands and the mat and web material. In addition, the matrix should be capable of achieving a rigid state of complete polymerization to become a rigid solid member with the reinforcing material and should also possess ability to adhere to the reinforced material. Some of the suitable thermoplastic resin matrix materials which can be employed for impregnating the reinforcing strands and mat, web and fabric materials are resins, such as polypropylene, polycarbonates, and the like. In many cases, it is desirable to use thermosetting resins such as phenolics and epoxy type resins as well. In addition, some thermosetting resins, such as the polyesters may also be used. These polyesters are preferably the condensation products from phthalic anhydride, maleic anhydride, ethylene or propylene glycols with a styrene monomer. Generally, the thermosetting resins should be capable of being fused into an insoluble, non-heat softening mass upon application of heat or similar method of triggering the catalytic system. Other binders which may be used are hard waxes, eutectic ceramics, eutectic metals, synthetic rubbers and the like.

In many cases, it may be desirable to introduce a particulate matter into the resin matrix and reinforcing material composite. This particular matter is desirable in some cases in order to provide the desired reinforcing characteristics and even ethestic appearance. There are a number of particulate materials which can be employed in the formation of the walled enclosure of the present invention and include for example, sand, particulate silica, and small hollow spheres of various materials, such as carbon and graphite. The walled enclosure of the present invention can be constructed with a wide variety of particle sizes of the particulate matter, and particularly, large particles in the range of 8 to 64 mesh and smaller particles in the range of 100 mesh to 5 microns. The amount of particulate matter can be programmed according to the amount of strand and mat delivery.

The strand or tape material may be formed of any continuous natural or synthetic filament, which is capable of being bent to conform to a desired shape. The mat and web material or fabric material will also be formed of discrete lengths of chopped filament material. The most preferred filament employed is that made of glass. However, it should be recognized that boron filaments, graphic tows, filaments from lithium and other grown whisker crystals can be employed. In addition, metal wire may even be interspersed with some of the filament materials in the event that it is desired to add some type of metallic body to the final walled enclosure. In the actual formation of the walled enclosure, a plurality of different reinforcing materials will be employed as hereinafter described in more detail. The exact composition of the final structure will be predicated on the environment in which the vessel is to be used, the size and strength requirements and like factors.

Mounted on the base plate 50, or otherwise integrally formed therewith, is an upstanding clevis-type bracket 74 which is capable of pivotally mounting a tether boom 76 in the manner as illustrated in FIGS. 1 and 2. The tether boom 76 is located in close proximity to and in alignment with the resin impregnating mechanism 70 in order to receive the resin impregnated strand and mat or web composite. Furthermore, the tether boom 76 is a hollow tubular member which is designed to convey the impregnated strand and mat or web material to an application head 80 carried at the upper end of the boom. It can be observed that the boom 76 is pivotally connected to the bracket 74 by means of pivot pins 78, which permit a locating of the application head 80 in the desired vertical plane. Furthermore, the boom 76 actually comprises a series of telescoping members in order to maintain the same circumferential path for the application head 80. Thus, as the boom is arcuately pivoted about the bracket 74 in an upwardly direction, the boom will automatically telescope to the desired length, so that the application head 80 is always maintained in the same circumferential path.

The application head 80 is also pivotally connected to the upper end of the tether boom 76, in the manner as illustrated in FIG. 3. This pivotal connection is created by a pair of brackets 82 which extends outwardly from the application head 80 and accommodate pivot pins 84, which are, in turn, journaled in a pivot ring 86 mounted on the upper end of the tether boom 76. Furthermore, a flexible bellows member 88 connects the upper end of the boom 76 to the application head 80 in the manner as also illustrated in FIG. 3.

The application head generally includes an outer housing 90 which is somewhat U-shaped in vertical cross-section so as to extend over the turns of the spiral walled enclosure thus formed, in the manner as illustrated in FIG. 1. Connected to the rearward end of the housing 90 in the manner as illustrated in FIG. 3, is a die housing 92 which is also U-shaped in vertical cross-section.

The application head 80 is moved along the portion of the walled enclosure thus formed by means of a head drive mechanism 94 including a drive roller 96 and a support roller 98 which are located within the housing 90. The drive roller 96 and the support roller 98 are rotatably carried by a bracket 100 by means of vertically disposed pintles 102, which are secured to the bracket 100 and the bracket 100 is, in turn, secured to the housing 90. Suitable bearings would also be employed to permit relatively friction free rotation of the rollers 96 and 98. By reference to FIG. 4, it can be observed that the drive roller 96 is located on the exterior surface of the side wall 12 being formed and the support roller 98 is located on the interior surface of the side wall 12 being formed.

The die housing 92 is also provided with a rearwardly extending bracket 103 which also rotatably carries an idler roller 104 and a trailing support roller 106. These rollers 104 and 106 are also suitably journaled on the bracket 103 by means of vertically disposed pintles 108. The support rollers 106 and 108 are located to bear against the interior surface of the upper portion of the walled enclosure thus formed and thereby support the application head 80 during its movement along the walled enclosure.

The drive roller 96 and the idler roller 104 operate in conjunction with each other by means of a drive belt 110 which is trained therearound. In addition, the drive roller 96 is driven by means of a suitable electric induction motor which is mounted on the bracket 100. It should be recognized that either one or both of the rollers 96 and 104 could be driven or only one of the rollers 96 could be driven. It should also be observed that other forms of drive means, such as fluid motor drives and the like, could be utilized in order to move the application head 80 along the walled enclosure.

The drive belt 110, which is powered for rotation through the drive roller 96, will engage the exterior surface of the walled enclosure thus formed along the upper periphery thereof. As the drive belt is thus rotated, it will cause movement of the application head along the walled enclosure in the direction of the arrow in FIG. 3. In this regard, the drive belt is preferably formed of a material which will maintain a driving friction contact with the walled enclosure but will not abrade the just deposited and cured reinforcing material. Further, it can also be observed that the application head will be driven along the walled enclosure in time related movement to the rotation of the base plate 50 and in coordination therewith.

The tether boom 76 will also contain a separate compartment which will carry electrical conductors and the like to the application head 80. Some of these conductors will be connected to the electric motor and thereby enabling the application head to be driven and controlled by the operator at the control console 62. Operating other of the conductors will be connected to components in the application head (to be hereinafter described) for complete control of all functions of the application head by an operator at the control console 62.

Other forms of driving the application head 80 about the walled enclosure in unison with the rotation of the base plate 50, could also be employed. One particularly effective method is to use a continuous belt which extends entirely around the outer surface of the walled enclosure near the upper periphery thereof. This continuous belt would be driven by one or a pair of drive rollers located in the application head 80, such as the rollers 96 and 104.

The components which form the apparatus A are constructed in such a manner that they can be readily assembled and disassembled lending to easy and convenient storage and transportation. Thus, it can be observed by reference to FIGS. 1 and 2, that the application head 80 is easily removable from the boom 76, and in like manner, the boom 76 is telescopically constructed. The boom 76 is also pivotally, but nevertheless removably mounted with respect to the base plate 50 for easy assembly and disassembly. The various components located on the base plate 50 are also removable so that each of the components can be stored as relatively small and compact units for easy transport and storage.

Welded or otherwise rigidly secured to the housing 90 and extending forwardly thereof, in the direction of movement of the application head 80, is a guide bracket 112 which is again U-shaped in vertical cross section. Another electric motor 114, or similar motive mechanism, is mounted on the guide bracket and drives a rotary wire brush 116 which extends through an aperture 118 formed in the upwardly presented surface of the bracket 112. This brush is located to engage and clean the upper surface of the turn of the spiral previously deposited in order to form better adhesion with the next adjacent turn to be applied. The bracket 112 will also carry a heating member, such as, for example, high intensity quartz lamps (not shown) for drying the turn of the spiral previously deposited.

Located within the housing 90 is a material receiving tube 120 which is designed to receive the impregnating mat, web or strand material composite which is carried by the tether boom 76. This receiving tube 120 is preferably formed of a non-metallic dielectric material, such as ceramic materials or the like, in order to permit conduction of dielectric energy, such as radio frequency energy. Mounted on the exterior surface of the housing 90 is a radio frequency oscillator cabinet 122 which provides radio frequency energy through the tube 120 to initiate a cure. The amount of energy which is transmitted to the impregnated composite through the dielectric tube 120 is only sufficient to initiate a cure, and consequently, this portion of the housing 90 will thereby form a pre-heating zone.

The impregnated reinforcing material which is pulled through the material receiving tube 102 is then introduced into a draw-die 124 located within the housing 92, and is "pultruded" through a draw-die orifice 126 formed within the draw-die 124. The details of construction of the draw-die 124 are more fully illustrated in FIGS. 6 and 7 of the drawings. In this particular case, the die 124 is provided with a die orifice 126 designed to produce a spiral turn having a cross-sectional shape as illustrated in FIG. 11 of the drawings. The draw-die 124 is preferably an externally heated forming/curing die, in that it serves at least two distinct functions. First of all, the die serves to gather the material and essentially form the material into the desired cross-sectional shape. Secondly, the die serves to cure the resin or other matrix material impregnated into the reinforcing material, during passage through the draw-die orifice. Thereafter, the material which is then cured is essentially deposited upon the previously formed turn of the spirally generated wall.

This technique for forming and curing the impregnated reinforcing material which may comprise many components as a conglutinate mass relies upon the concept of pultruding. The concept of pultrusion is more fully illustrated and described in U.S. Pat. No. 2,871,911. This form of pultrusion process can be characterized in that the impregnated reinforcing material is essentially pulled through the draw-die orifice under tension, and during the pulling of the material through the orifice, the die imparts the desired cross-sectional shape to the material. The die is also designed to permit the initiation of at least a partial polymerization of the resin while the shaped conglutinate is within the die in order to insure retention of the applied shape. In the general pultrusion process, the conglutinate mass is essentially pulled through the draw-die orifice by one or more gripping mechanisms or other forms of puller mechanisms. However, in the instant application, the conglutinate mass, after passing through the draw-die orifice, is fixedly attached by bonding to the previous turn of the spiral wall. With the application head 80 continuously moving along the spiral wall, the conglutinate mass is effectively pulled through the drawdie orifice.

By further reference to FIG. 7, it can be observed that the die 124 includes a pair of oppositely disposed electrodes 128 which are operable with a dielectric energy generating unit, such as a dielectric energy generator 130 located on the base plate 50. In this particular case, the electrodes 128 will create a dielectric energy flow through the mass contained within the die to thereby initiate the polymerization of the resin material.

The dielectric curing mechanism of the present invention will operate with both radio frequency energy and with microwave energy, as aforesaid. The radio frequency generator will generate energy within a frequency range of approximately 13 megahertz to approximately 100 megahertz, and preferably within the range of approximately 13 megahertz to approximately 50 megahertz. The microwave generator will generate energy within the range of approximately 950 megahertz to approximately 25,000 megahertz, and preferably within the range of approximately 1,500 megahertz to approximately 5,200 megahertz. Accordingly the term "dielectric" as used herein will generally refer to both radio frequency energy in the stated frequency range of approximately 13 megahertz to approximately 50 megahertz and microwave energy in the stated frequency range of approximately 950 megahertz to approximately 25,000 megahertz.

While the theory of microwave and radio frequency curing is not completely understood, it is believed that the curing, in part, occurs by molecular interaction, and particularly, molecular friction. The molecules of the resin have a polar structure, such that when an electrical field is introduced across the molecules of the resin, the molecules will tend to orient in the direction of the field. After release of the field, the molecules will attempt to re-orient back to their original direction. This action is believed to create a frictional effect between the molecules and thereby produce heat in the resin matrix. However, those composites which contain metallic materials, either a metallic filament or a metallic type resin matrix, will generally cure through inductive heating.

Furthermore, the employment of dielectric curing and precuring is also believed to be significant in the present invention in that this type of curing enables the initiation of the cure at the center of the mass. Inasmuch as the thermal conductivity of the resin fiber composite allows the surface heat to dissipate, the surface of the mass will cool slightly with respect to the remainder thereof. Accordingly, the center of the mass achieves a given temperature prior to the surface of the mass. In this manner, the cure will actually begin from the center of the mass. Accordingly, any outgasing of air which may be entrained in the composite does not create any fissures or cracks.

The ability of the resin matrix to accept the electrical energy is dependent upon the electrical loss tangent of the resin system. Accordingly, the resins are selected with a proper electrical loss tangent for use in the dielectric curing system of the present invention. Generally, these thermo-setting resins mentioned above are preferred since they all have the proper electrical loss tangent for use in this system. The resins all have a high electrical loss tangent in the monomeric form, and a low electrical loss tangent in the polymeric form. The electrical loss tangent is actually effected by the dielectric strength of the material, and the dissipation factor of the material. In this manner, the curing process is self limiting, so that the resin matrix essentially cannot be over-cured. When the cure is complete, the amount of additional energy accepted by the resin matrix is very materially reduced.

It has also been found in connection with the present invention that the use of dielectric curing, as defined herein, enables a substantially higher running rate in the production of turns of the spiral wall, than any other type of curing unit available. In addition, it has been found in connection with the present invention, that the employment of dielectric curing enables the production of a walled enclosure with essentially no cracks or voids, where other heating techniques result in a high loss rate by virtue of inclusion of cracks and voids.

One of the most preferred cross-sectional shapes and composite structure for the turn of the spiral is more fully illustrated in FIG. 11 of the drawings. It can be observed that the turn comprises a central core of one or more layers 132 of centerpoid crossply woven rovings of fiber containing material, and a layer 134 of linear fiberglass rovings or other fiber containing rovings. Incidental to the layer 134 of the linear fiberglass rovings is an interior double thickness layer 136 of fiberglass mat material. Incidental to the layer 132 of centerpoid crossply woven rovings is an outer layer 138 of fiberglass mat or other fiber containing reinforcing mat material. When the cure is initiated in the draw-die 124, it is controlled so that the conglutinate mass will have an innermost resin-rich layer 140 and an outermost resin-rich layer 142.

The composition of the turn just described, and as illustrated in FIG. 11, is the most preferred form of material construction, although it should be understood that a number of compositions could be used with the system of the present invention. For example, additional layers of mat and/or roving material could be employed. In addition, it is possible to intermix various forms of reinforcing material. Thus, for example, it would be possible to use a fiberglass mat material and linear boron roving material.

It should be observed that the die in each case in the present invention is not a closed, shape-encompassing die, but is in the form of an inverted U, with the fourth side effectively closed by the upper surface of the spiral turn previously deposited. Thus, while the application head 80 advances along the spirally generated wall effectively astraddle over an already formed and cured turn. New and uncured material is constantly being drawn into the U-shaped die where it is forced in a partially cured condition through the die and against the uppermost turn of the wall, and where it is continuously bonded and cured thereto.

In this case, one particular turn will have the preferred cross-sectional shape as illustrated in FIG. 11 and will include enlarged upper and lower ends 144 and 146, respectively. The upper end is integrally formed with a tongue 148 having upwardly and outwardly converging walls, and the lower end is formed with a groove 150, which is sized to accommodate a tongue on another turn. Thus, as each turn of the spiral is formed, it is continuously deposited on the previously formed turn, so that the tongue on the upper end of the previously turn will fit within the groove 150 on the next applied turn of the spiral.

The mating of the tongue 148 and the groove 150 is somewhat like a "zipper" arrangement where the new turn of material is actually formed on and simultaneously deposited on the previously formed turn, with the tongue 148 essentially fitting into the groove 150. In this way, a very effective rigid attachment is achieved. Furthermore, when the new turn is applied to the spiral wall, the curing which has been initiated will be completed as the turn is immediately deposited, so that the uppermost turn will be effectively cured and integrally bonded with the turn immediately therebeneath. It can also be observed that this type of turn structure enables the generation of a tank which has a series of hoops formed by the enlarged upper end of the turn 144 mating with the lower end 146 of the next turn immediately thereabove.

The draw-die 124 as illustrated in FIGS. 6 and 7 of the drawings is only one form of die mechanism which can be utilized in the present invention. It should be recognized, in this regard, that the application head 80 is designed so that the draw-die 124 can easily be changed in order to obtain the desired cross-sectional shape of the spiral turn. FIGS. 8, 9 and 10 illustrate additional embodiments of draw-dies which can be utilized in the present invention. Thus, for example, FIG. 8 illustrates a draw-die 152 which has a die orifice 154 designed to generate a spiral walled turn having a V-shaped projecting lower end 156 and an indented V-shaped upper end 158. In this particular case, the projecting V-shaped lower end of one turn will fit within the indented V-shaped upper end of the previously deposited turn.

FIG. 9 illustrates an embodiment of a draw-die 160 which includes a U-shaped die orifice 162 formed by a central interior rigid core 164. In this particular case, the conglutinate mass will exit the die in the form of an inverted U-shaped member and will be deposited upon the previously applied turn, which is also formed with an inverted U-shape. Thus, each turn will form a continuous central aperture 166 which will continue throughout the entire walled enclosure. This type of walled structure is effective where it may be desirable to introduce cooling or heating fluids or other forms of fluids into the continuous passageway which extends throughout each turn of the spiral in the wall.

Another embodiment of a draw-die 168 is more fully illustrated in FIG. 10 of the drawings. This particular form of die is essentially a "split-die" in that it includes a draw-die orifice 170 which is rectangular in shape, and is provided with a somewhat oval shaped rigid core 172 extending centrally therewithin. In this case, the conglutinate material would pass through the draw-die orifice 170 so that the final turn will be comprised of a wall segment 174 having a hollow oval shaped interior 176. In addition, the die is formed with a second draw-die orifice 178 which is spaced from the orifice 170 to thereby generate a wall segment 180. This wall segment 180 is spaced from the wall segment 174 having the central interior aperture 176 to thereby provide a continuous void 182 therebetween. This void 182 would be designed to accommodate a foam material or like material in the event that it was desired to provide temperature insulation or other forms of insulation to the tank thus generated.

After the tank wall has been completely generated to the desired height, a spray-up tank floor 184 may be formed, in the manner as illustrated in FIGS. 12*d*, 13*d*, and 14*c*. In many cases, it may be desirable to employ a tank floor seal 186 in the manner as illustrated in FIG. 14c. The tank floor seal 186 may be formed of any suitable fluid impervious material. The tank floor is generally formed of a sprayed-up resin, or otherwise, a combination of glass or other reinforcing mat material impregnated with the resin which is then allowed to polymerize. In addition, a wall/floor fillet 188 is then layed up against the corner of the base or floor 184 and the wall 12, in the manner as illustrated in FIGS. 12*d*, 13*c*, and 14*c*. This wall/floor fillet 188 is also preferably formed of a resin-impregnated fiber containing mat material which may be conveniently layed up by hand.

In addition to the laying of a tank floor, an upper stiffening ring attachment is also applied to the upper end of the walled enclosure thus generated, as more fully illustrated in FIGS. 15*a* – 15*c*. Initially, a temporary ring 190 formed of wood or similar material is attached to the upper end of the wall as illustrated in FIG. 15*b*. The temporary ring 190 may be formed of a series of planks which are circumferentially disposed around the tank wall in abutting engagement. The planks which form the ring 190 are provided with a plurality of circumferentially spaced vertically disposed apertures 192 in order to removably receive tank top attachment bolts 194. A filament wound stiffening ring or so-called "girt ring" 196 is then applied to the upper end of the wall in the manner as illustrated in FIG. 15*c*. Thereafter, the temporary ring 190 is removed. In this case, the bolts 194 which are then rigidly secured within the hardened stiffening ring 196 are capable of retentively holding a tank top on the walled enclosure thus generated.

FIGS. 20 and 21 illustrate two forms of storage vessels which may be fabricated in accordance with the present invention. By reference to FIG. 20, it can be observed that the storage vessel V is provided with a top wall 196 having an integrally formed downwardly struck annular flange 198. The upper end of the top wall 196 along the periphery thereof would be provided with apertures which are sized to accommodate the bolts 194. Furthermore, these bolts are externally threaded in order to receive nuts or other forms of attachment means. It should be observed that the stiffening ring and attachment mechanism illustrated in FIG. 15c is only one form of attachment mechanism which could be utilized in accordance with the present invention.

The top wall 196 is preferably, though not necessarily formed of a reinforced composite material. This top wall could be separately layed up or otherwise formed with a resin impregnated glass mat or like material. Otherwise, the top wall could be formed of any suitable plastic material or other material, for that matter.

FIG. 21 illustrates another form of storage vessel which may be constructed in accordance with the present invention. In this particular case, the tank wall is generated in the same manner as previously described. However, a somewhat hemispherically shaped top wall 200 is designed to "float" within the tank wall 12. In this latter embodiment, it should be recognized that guy wires or other forms of securing mechanism would be used to hold the top wall 200 in its closurewise position.

In use, the apparatus A can be conveniently and easily transported to a site of utilization and thereafter rapidly and efficiently assembled with a minimum of manual labor. As indicated previously, the components of the apparatus, for the most part, are individual units which are easily connected together in order to form the final apparatus. The tank footing is prepared in the manner as previously described. Again, the exact form of tank foundation or footing which may be utilized is dependent upon several factors, including the condition of the ground or other supporting surface, the type of loads which are to be retained within the storage vessel and like factors.

After the foundation bed has been formed and the starting ring 42 located in position, the actual spiral wall generation can begin. In this case, the boom will be located at a relatively low level, in the manner as illustrated in the dotted lines of FIG. 1. The start up may be somewhat slow since the forming/ curing application head 80 must be controlled and observed in order to assure alignment while the first and bottom most course or turn is being formed. Furthermore, the terminal elevation of this first turn must be equal to the height of each ensuing turn. However, after the bottom turn has been formed, the system can be speeded up to a normal rate which can be at least 2 to 4 feet per minute or more. Beyond that point, the apparatus requires very little surveillance of any kind, except for an occasional checking of infeeding materials, curing energy levels and the like. It should also be observed that the apparatus may be stopped and re-started, as necessary without effecting the quality of the walled enclosure being generated or otherwise effecting the sequence of operation.

As the height of the walled enclosure increases, the telescoping boom will be raised and simultaneously extended so that the application head 80 always remains in the same circumferential path. This telescoping extension will occur automatically as the application head raises with the increased height of the walled enclosure. However, in this connection, it should be observed that the operator control panel could have over-riding controls in order to either extend or retract the telescoping boom to the desired length. Thus, if it was desired to form a somewhat hemispherical, or otherwise non-linear wall, the operator could control the extension of the boom and hence the location of the application head in order to obtain the desired wall generation path. Thus, if it was desired to form a hemispherical wall, the boom could be held in a non-extendable position so that as the application head was raised, it would also simultaneously follow somewhat of an upward arcuate path.

After the tank wall has been generated, the floor/wall fillet is then applied in the manner as previously described and in addition, the tank top attachment is also applied in the manner as previously described.

The final storage vessel may be provided with one or more fittings such as fluid connections (not shown). These connections can be very easily formed in the vessel of the present invention by merely fly-cutting a hole through the tank wall into which the fitting is to be inserted. Flange or ring faces are buttered with a sealant which also compensates for wall curvature, and is the drawn tight. It should also be recognized that the vessels produced in accordance with the present invention highly lend themselves to field-type repair, in that any damage can be easily corrected by means of patches or like members. Furthermore, holes or other forms of similar damage to the vessel can be plugged with resin-wet reinforcement and allowed to cure, and thereafter provided with a surface patching.

Another form of apparatus B which is more fully illustrated in FIGS. 17–19 can also be used to generate the walled enclosure. When using the apparatus B, it is generally desirable to previously form a poured concrete or other structural foundation plate 210, in the manner as illustrated in FIG. 17. By using the poured concrete or other structural material foundation plate 210, the necessity of constructing the foundation bed previously described is eliminated. Thereafter, a starting ring, such as the starting ring 42, illustrated in FIG. 16, could be secured to the foundation plate 210 or otherwise, the starting ring 42 could be integrally formed therewith during the construction of the foundation plate 210.

The apparatus B generally comprises a self-powdered carriage 212 which is powered by its own internal engine 216, such as a gasoline powered generator or engine, electric motor or other source of power. The carriage 212 is further provided with an operators central control panel 218 for control of all functions of the apparatus B from this central control panel. Electrical conductors 214 would extend from a central control on the carriage 212 to an application head to be hereinafter described in more detail. In addition, a dielectric frequency energy generator 220 would be located on the carriage 212 for supplying dielectric energy to the application head (hereinafter described).

The reinforcing material which may include both the web and mat fiber containing reinforcing material as well as the strand and/or tape fiber containing reinforcing material, could be carried on a second carriage or so-called "follower carriage" 222. This follower carriage 222 is pivotally connected to the powered carriage 212 by means of pivotally connected links 224 and a pivot pin 225. The reinforcing material will extend from the creels or other racks 227 on the carriage 222 into a resin impregnating tank or other form of resin impregnating mechanism 226 on the carriage 212 for resin impregnation thereof. It is also possible to increase the size of the powered carriage 212 for locating all of the reinforcing material thereon, if desired. It should be observed that the wheels on the powered carriage 212 would be operatively connected to the engine 216 for moving the carriage 212. Further, the wheels on both the powered carriage 212 and the follower carriage 222 would be turned or angulated slightly to follow the arcuate path of movement during wall formation.

Also mounted on the carriage 212 so as to be movable therewith, is an upstanding support post or so-called "boom" 228 which carries a vertically shiftable application head 230 thereon. The application head, in this case, is quite similar to the application head 80 except that it is provided with a hollow mounting post 232 for shiftable movement in a vertical direction on the boom 228. The resin impregnated conglutinate mass, in this case, is merely pulled from the resin impregnating tank 226 and introduced directly into the application head 230, instead of introducing the mass through the hollow boom, as in the apparatus A.

The carriage 228 is preferably fixed to the starting ring 42 by means of a guide 234 in order to insure movement in a truly circular path during the formation of the walled enclosure. In addition, the upper end of the boom 228 may be connected to an upstanding support beam or rod 238 and the lower end of this support rod 238 will be fixedly connected to a pin or other retaining member (not shown) which is removably located at the center of the walled enclosure. This support rod 238 will serve to insure movement of the boom 228 in a truly circular path.

The application head 230 is similar to the application head 80 previously described, as aforementioned. However, the conglutinate mass, designated as 236 in FIGS. 17 and 18, enters one end of the application head, that is the forwardly presented end, in the direction of movement of the head 230, and is passed through both the pre-curing zone and a draw-die orifice where it is finally cured. Furthermore, the conglutinate mass which is formed into the turn of the spiral is then deposited upon the previously applied and cured turn of the spirally generated wall. As the walled enclosure increases in height, the application head 230 will continually shift upwardly on the boom 228.

Thus, it can be observed that the apparatus B is capable of generating a walled enclosure, much in the same manner as the apparatus A. Furthermore, the apparatus B generally includes only the movable carriage 212, the boom structure 228 and the follower carriage 222. Consequently, with this embodiment of the apparatus B, it is very easy to move the equipment to an on-site location for immediate generation of the walled enclosure. Furthermore, the walled enclosure can be finished in the same manner as previously described.

Each of the above described apparatus A and B and the methods therefor operate on the principal of using a primary bonding for applying a new turn of reinforcing material to a previously applied turn of reinforcing material. In this primary bonding principle, the resin matrix or other binder impregnated into the reinforcing material is effectively cured when the new turn is applied to a previously deposited turn. In this way the uncured matrix which exists between the previously deposited turn and the new turn is cured so that an actual and integral bond is formed between the new turn and the previously deposited turn.

In the following embodiments of the present invention the apparatus and method operate on the principle of using a secondary bonding for applying a new turn of reinforcing material to a previously applied turn of reinforcing material. In the secondary bonding, the matrix material impregnated into a new turn of the reinforcing material is cured before applying the new turn to a previously deposited turn. The new turn is then applied to the previously deposited turn and bonded thereto with an additional binder agent located between the two turns and hardened. Furthermore, the new turn may also be mechanically affixed to the previously deposited turn. This latter form of operation using secondary bonding is desirable where thermal shrinkage may affect the bonding in certain selected resin matrix-reinforcing material compositions.

FIGS. 22 and 23 illustrate a further modified form of apparatus C for constructing the storage vessel and which utilizes the secondary bonding mode of operation. FIG. 22 illustrates several of the components such as storage racks and creels of supply materials used in the making of the walled enclosure, although many of these components have been eliminated from FIG. 23 for purposes of clarity.

The apparatus C is also designed to fabricate those type of walled enclosures or storage vessels which are, for example, illustrated in FIGS. 20 and 21 of the drawings. In addition, when using the apparatus C, it may also be desirable to prepare a proper foundation or so-called "tank footing" prior to the actual generation of the tank side wall, much in the manner as illustrated in FIGS. 12–14 of the drawings. In like manner, it may also be desirable to use an initial starting ring, such as the starting ring 42 described above.

The apparatus C generally comprises a base plate 250 which is supported by a plurality of circumferentially spaced legs 252 spaced around the periphery of the base plate 250 and which are engageable with the ground or other supporting surface. The base plate 250 and the assembly to be hereinafter described which comprises the apparatus C will generally be included within the periphery or boundary line upon which the storage vessel or walled enclosure is to be formed. The base plate 250 is centrally apertured to accommodate an upstanding king post 254, which is provided at its lower end with a foundation plate 256 for disposition on the ground or other supporting surface.

A horizontally disposed support plate 258 is also provided for mounting on the king post 254, and is parallel to and spaced upwardly along the post 254 from the base plate 250. The support plate 258 is provided with an undercarriage 260, and rotatably mounted on the undercarriage 260 are a plurality of circumferentially spaced rollers 262 which are designed to ride along a circular track way 263 formed on the upper surface of the base plate 250. Interposed between the undercarriage 260 and the base plate 250 is an enlarged ring gear 264 which is also mounted on the king post 254. This ring gear 264 meshes with a pinion gear 266, and this pinion gear 266 is driven by an electric motor 268 located on the undercarriage 260, in the manner as illustrated in FIG. 23.

In an alternative arrangement, the rollers 262 could be powered by suitable individual electric induction motors (not shown). However, other forms of drive means and other power sources could be employed in accordance with the present invention. The various drive wheels 262 are operated in unison from a central control source, such as an operator's control panel 270 located on the upper surface of the support plate 258. An energy driven generator (not shown) but which is similar to the generator 263, may also be located on the support plate 258 in order to provide a source of power.

The support plate 258 is also designed to accommodate all of the various components needed to provide the resin matrix impregnated filament reinforcing material. Thus, referring to FIG. 22, it can be observed that storage racks or storage creels 272 are located on the upper surface of the work plate 258 and are designed to hold spools or rolls of filament containing strands or tapes. Again, these spools are rotatably mounted on the creels 272 so that the strand or tape material may be removed therefrom upon demand. Furthermore, rotatably mounted rolls or spools of reinforcing mat or reinforcing web material 274 (often referred to as "fabric material") are also located on the support plate 258. Thus, various forms of fabric material containing the fiber reinforcement may be simultaneously or alternately fed from the spools 274 with respect to the tape or strand material pulled from the creels 272.

The various fabric materials from the rolls or spools 274 and the tape and strand material issued from the creels 272 are passed through a carding plate 276 and introduced into a resin matrix impregnating dip tank 278, in the manner as illustrated in FIG. 22 of the drawings. Again, a suitable resin matrix impregnating canister of the type mentioned above could also be substituted for the resin impregnating dip tank 278. In either case, the resin matrix which is contained within the dip tank 278 or the impregnator is thoroughly impregnated among the various fibers contained within the strand or tape material or the fabric material. Those resin matrix composition described above and the various reinforcing materials described above are also capable of use in connection with the apparatus C.

It can be observed that the support plate 258 is designed with a suitable overall size to accommodate an inventory of needed material, such as the resin containers, or spare rolls of mat or web material or extra creels, as may be needed. Thus, it can also be observed that the support plate 258 with the components located thereon constitute a self-operating unit for enabling accumulation of proper amounts and sources of the reinforcing material for ultimate formation into a spiral ring.

After the reinforcing material has been impregnated with the resin matrix, the excess resin matrix can be removed by means of a doctor blade or nip rollers (not shown) as may be desired. This impregnated material is then introduced as a bundle into a dielectric energy chamber 280 which is supplied with dielectric energy from a dielectric energy generator 282, also mounted on the support plate 258. In this particular situation, the dielectric energy which is introduced into the chamber 280 is similar to the dielectric energy generated by the dielectric curing mechanism described above. Further, the amount of energy which is introduced into the chamber 280 is only sufficient to enable a partial polymerization of the resin matrix which is impregnated into the reinforcing material. In this way, an initiation of a cure has already started and consequently, the amount of energy applied in a final cure which is necessary to completely cure the resin matrix has been substantially reduced.

After the impregnated and partially cured reinforcing material exits the dielectric energy chamber 280, it is trained around a guide plate or so-called "shoe" 284 which is also mounted on the support plate 258 and thereafter introduced into a combination curing and shaping draw-die 286 having a draw-die orifice 288. The draw-die 286 is similar in construction to the previously described draw-die 124 in that the impregnated reinforcing material is effectively "pultruded" through the draw-die orifice 288. In like manner, the draw-die 286 is designed to produce an ultimate turn in the walled enclosure having a cross-sectional shape as illustrated in FIG. 29 of the drawings.

The draw-die 286 is designed to serve at least two distinct functions. First of all, the draw-die 286 will serve to gather the bundle of impregnating reinforcing material which has been partially cured and essentially forms this reinforcing material into the desired cross-sectional shape. Secondly, the draw-die 286 serves to cure the resin or other matrix material impregnated into the reinforcing material during passage through the draw-die orifice 288. In this respect, the draw-die 286 may be provided with external heaters or other means to introduce energy into the resin matrix mass.

It can be observed that the combination of the precuring which occurs in the dielectric chamber 280 and the final curing which occurs in the draw-die 286 produces an augmented type of cure which is highly effective in producing a pultruded stock. However, it should also be understood that the draw-die 286 could be conveniently located within the dielectric energy chamber 280. In this case, the amount of energy which is introduced into the chamber 280 would be sufficient to produce a complete cure of the resin matrix material impregnated into the reinforcing material.

The fully cured resin matrix impregnated reinforcing material is pulled through the aforementioned components such as the resin impregnator member 278, the chamber 280, and the draw-die 286, by means of a pulling mechanism 290, which is more fully illustrated in FIG. 22 of the drawings. This pulling mechanism 290 generally comprises a pair of oppositely disposed frames 292 and 294, the latter of which is biased toward the frame 292. Each of these frames 292 and 294 are provided with a plurality of longitudinally spaced brackets 296 and 297 respectively for carrying a plurality of driving rollers 298 and 299 respectively. The frame 294 is biased in such manner that the pairs of opposed rollers 298 and 299 will bear against the pultruded stock. These rollers are driven by means of a conventional electric motor 300 in order to pull the pultruded stock through the system as described. However, the frame 294 is biased with respect to the frame 296 in order to account for any non-linearities in the pultruded stock. Notwithstanding, the pulling mechanism 290 could effectively adopt any form of pulling mechanism, such as that which is more fully illustrated and described in the aforesaid U.S. Pat. No. 2,871,911.

The impregnated reinforcing material which is pulled through the aforesaid system by the pulling mechanism 290 is introduced into an application head 302 which is more fully illustrated in FIGS. 27 and 28 of the drawings and which is also more fully described in detail hereinafter. This application head 302 is carried by a leg 304 which is pivotally mounted on the outer end of the support plate 258.

In addition a spider structure is mounted on the support plate 258 and includes a plurality of circumferentially spaced radially extending legs 306. Mounted on the outer ends of each of these legs 306 are guide and support heads 308. These guide and support heads 308 each include a pair of outer horizontally disposed rollers 310 and a pair of inner horizontally disposed rollers 311 which are designed to bear and ride against the exterior and interior surfaces, respectively, of the walled enclosure as it is formed. Each of the guide and support heads 308 further includes forward and rearward vertically disposed rollers 312 which are designed to ride against the uppermost surface of the just deposited turn of reinforcing material in the walled enclosure.

It can be observed that the support plate 258 and hence the entire spider structure 305, moves in timed related movement to the production of the cured matrix impregnated reinforcing material. Thus, this material which is pulled through the puller 290 enters the application head 302 which moves along the periphery of the walled enclosure as it is formed. The support plate 258 and the entire spider structure 305 rotates in this timed related movement and the legs 306 of the spider structure 305, move around the walled enclosure and are supported at their outer ends by means of the guide and support heads 308.

It should also be observed that some form of takeup device such as a reserve coil or storage loop could be formed of the reinforcing material prior to entry into the application head 302. In this way, it would then be possible to avoid the necessity of careful timing of the production of the reinforcing material with respect to the movement of the support plate 258 and hence the application head 302.

The leg 304 which carries the application head 302 and each of the legs 306 of the spider structure 305 are pivotally mounted within recesses 314 in the support plate 258 by means of pivot pins 316. Furthermore, horizontally disposed struts 318 extend from the king post 254 to the recesses 314 on the underside of the support plate 258 to provide additional support.

By means of the above outlined construction, the legs 304 and the legs 306 are capable of shifting movement through a vertical plane about the pin 316. Thus, again referring to FIG. 23, it can be observed that the application head 302 as well as the various guide and support heads 308 would initially be located along the lower margin of the walled enclosure. The application head 302 as well as the various guide and support heads 308 would pivot about the pins 316 and automatically shift upwardly, as the size of the walled enclosure increases during the formation thereof.

In this respect it can be observed that the application head 302 is pivotally mounted on the arm 304 and the various guide and support heads 308 are pivotally mounted on the arms 306 so that these heads 302 and 306 maintain a substantially true vertically disposed position during the arcuate upward movement of the arms 304 and 306. Further, it should be observed that both the arm 304 and the various arms 306 of the spider structure 305 are extensible so that they maintain the application head 302 and the various guide and support heads 306 in a substantially continuous circular path which is registered with the walled enclosure being formed.

As an alternative mode of construction, the present invention also contemplates the raising of the support plate 258 with respect to the ground or other support surface as the size of the walled enclosure increases during the formation thereof. In this case a suitable hydraulic motor, or other prime mover (not shown) may be operatively associated with the king post 254 for raising the support plate 258, the application head 302 on the arm 304 and the spider structure 305 as the height of the walled enclosure increases during the formation thereof. Furthermore, it is possible to use the initial construction of pivotally mounted arms 304 and 306 which are also extensible for shifting upwardly as the walled enclosure height increases, along with motive means to shift the support plate 258 upwardly. This form of construction is particularly desirable in those cases where the walled enclosure is to be constructed with a substantial height.

The turn of the walled enclosure which is produced by the apparatus C is more fully illustrated in FIG. 29 of the drawings, as aforesaid, and is designated with reference numeral 32d. This turn 320 will have a material composition similar to the composition of the turn illustrated in FIG. 11 of the drawings. In this respect, each turn would comprise a central core of centerpoid crossply woven rovings of fiber containing material as well as layers of linear fiberglass rovings or other fiber containing rovings. In addition, this turn would also contain the fiberglass mat material or other fiber containing reinforcing mat or fabric material and would also be provided with an innermost resin rich layer and an outermost resin rich layer.

Each turn comprises an upper vertical leg 322 having an inwardly presented vertically disposed relatively flat face 324 (reference being made to the interior of the walled enclosure to be formed). At is upper end, the leg 324 is integrally provided with an enlarged protruding portion or boss 326 for reasons which will presently more fully appear. The upper leg 324 integrally merges at its lower end into an enlarged connecting section 328 which is provided with a pair of diagonally located and opposed recesses 330 and 332, respectively. These recesses 330 and 332 are sized to accommodate a boss of the type equivalent to the boss 326. The enlarged connecting section 328 also integrally merges into a downwardly struck leg 334 having an integrally formed enlarged lower boss 336 at its lower end, and which leg 334 includes a relatively flat exteriorly presented face 338.

One turn of the walled enclosure such as the turn 320 is applied to a previously deposited turn designated as 320' in FIG. 29. In this case, it can be observed that the enlarged upper boss 326 of the turn 320' snuggly fits within the recess 332. In like manner, the enlarged lower boss 336 on the turn 320 would snuggly fit within the recess 330 of the turn 320'. In this respect, it should be observed that a suitable adhesive or binder is applied in the region between the enlarged bosses and the recesses in which they fit in the mated turns. Thus, for example an adhesive or binder is located between the boss 326 of the turn 320' and the recess 332. Furthermore, an adhesive or other binder agent would also be applied at the recess 330 of the turn 320' and the enlarged hub 336 of the turn 320.

By further reference to FIG. 29, it can be observed that a central aperture 340 is formed between the lower leg 334 of the turn 320 and the upper leg 322 of the previously deposited turn 320'. In a new pass of the application head 302, the turn 320 then serves as the previously desposited turn and a new turn 320'' is applied to the turn 320. In this case, it can be observed that the lower leg 334 of the turn 320'' has the enlarged boss 336 thereof, inserted within the recess 330 of the turn 320. In like manner, the enlarged boss 326 on the turn 320 fits within the recess 332 of the turn 320''. Again, it can be observed that an aperture 340' is formed between the turns 320 and 320''. In this respect, it should also be observed that this aperture is a continuous aperture generated throughout the entire walled enclosure and forms a continuous duct. Further, this continuous aperture can be highly effective as serving as a conduit for conveyance of fluid, or as a void for purposes of heat insulation or the like.

It can be observed that the turn 320 is uniquely designed so that the application head 302 can effectively apply the new turn 320 to the previously deposited turn 320' during movement along the portion of the walled enclosure as it is formed. Furthermore, it can be observed that the two turns are not only chemically bonded through the use of the bonder or adhesive, but that the two turns are also mechanically attached. In this respect, the boss 326 of one turn could be sized to snuggly fit within the recess 332 of the next lower turn, and the boss 336 could be sized to snuggly fit within the recess 330 in a type of "snap-fit". Thus, the application head 302 essentially fastens the new turn to the previously deposited turn in somewhat of a "zipper" arrangement. Consequently, a very effective rigid attachment between the two turns is achieved. Furthermore, when the adhesive or bonding agent which has been applied to the turns is cured, a rigid chemical bond is also achieved.

FIG. 30 illustrate another modified form of turn construction which can be used in the present invention. In this case, each turn 342 is provided with an upper leg 344 having an enlarged boss or knob 346 integrally formed with the upper end thereof. At its lower end, the leg 344 integrally merges into an enlarged connecting portion 348 which is provided with an outwardly struck flange 350 spaced from the leg 344 thereby forming a U-shaped channel 352. The upper leg 344 is provided with an inwardly presented face 354, that is the face 354 is presented inwardly with respect to the walled enclosure. The connecting portion 348 has a downwardly struck integrally formed lower leg 356, the latter also terminating at its lower end in an enlarged boss 358. The leg 356 also has a downwardly struck flange 360 spaced inwardly thereof, thereby forming a channel 362. In this respect, it can be observed that the one turn 342 is designed to accommodate a lower turn 342' and an upper turn 342'' much in the same manner as the turn 320. Furthermore, both a physical and a chemical bonding may be achieved between the two abutting turns.

FIG. 31 illustrates a further modified form of turn construction which can be used in the present invention and which is highly effective in the generation of a wall enclosure. In this case, each turn 364 comprises a pair of spaced apart vertically depending legs 366 and 368 which are connected at their upper ends by means of a transverse connecting bight 370. At their lower ends, each of the legs 366 and 368 are provided with inwardly struck locking stubs 372 which form therebetween a tapered head receiving recess 374. At its upper end, the connecting bight 370 is integrally provided with an enlarged upwardly extending locking head 376 and a pair of opposed upwardly projecting flanges 378 which form locking recesses 380.

In accordance with this turn construction, it can be observed that one turn 364 can be rigidly locked to a next lower-most turn 364' and a like uppermost turn can also be locked to the turn 364. In this case, the locking stubs 372 of the newly applied turn 364 will snuggly fit within the locking recesses 380 of the previously deposited turn. In like manner, the locking head 376 of the existing turn will extend into locking recess 374 of the newly applied turn 364. It should also be observed that the adjacent and vertically registered turns in the walled enclosure form a continuous aperture 382, and this aperture 382 will thereupon generate a continuous duct throughout the walled enclosure.

It is possible to provide other forms of turn construction in accordance with the present invention. It is only necessary to change the cross-sectional shape of the draw-die orifice 288 in order to produce the desired turn configuration. Consequently, any of the number of forms of turn constructions which permit both a chemical and physical bonding may be utilized in accordance with the present invention.

The application head 302 is more fully illustrated in FIGS. 27 and 28 of the drawings. In this case, the application head 302 travels in the direction of the movement of the arrow in FIG. 27 along the portion of the walled enclosure which was formed and which is designated by reference numeral V. Furthermore, the application head 302 also receives a fully cured turn of impregnated reinforcing material, again designated as 320 (although any form of turn construction could be used which is applicable in the present invention) for application to the previously deposited turn on the walled enclosure V. The application head is designed to both physically and chemically bond this new turn 320 to the previously deposited turn 320 in the manner as previously described.

The application head 302 includes a source of motive power, such as a conventional AC electric motor 384 or any other form of motive power, such as a fluid drive motor or the like. Connected to the trailing end of the motor 384 is a conventional gear box 386 which is designed to reduce the overall speed of rotational power generated through operation of the motor 384. The motor 384 and the gear bos 386, as well as other components to be hereinafter described, are located within a trapezoidally shaped outer housing 388 which forms a central cavity to receive the new turn to be applied and the upper portion of the walled enclosure thus formed. The housing 388 carries four vertically disposed pintles 389 for rotatably supporting vertically disposed drive rollers 390, in the manner as illustrated in FIG. 27 of the drawings. It can be observed that two pairs of drive rollers 390 are formed and one roller in each of the pairs is disposed on the exterior surface of the new turn 320 whereas another of the rollers in each pair of rollers is disposed on the interior surface of the new turn 320.

The housing 388 includes at its forward end in the direction of movement thereof, a pair of brush rollers or so-called "brushes" 392. These brushes 392 are located and designed to clean the portions of the previously deposited turn on the walled enclosure V in those regions in which a chemical bonding is to occur, and to clean the new turn 320 in those portions in which chemical bonding is to occur. Furthermore, additional cleaning brushes (not shown) may also be provided at the forward end of the housing 388 for different turn constructions where additional cleaning would be required.

An air jet 394 in the housing 388 is located to force an airstream under pressure against the last deposited turn on the walled enclosure V and also against the new turn 320 prior to the application thereof. This airstream under pressure is designed to remove any dust or other foreign particulate matter from these two members before the application of an adhesive and subsequent bonding. Furthermore, this air jet 394 is effective to blow off water, such as rainwater, which would enable the walled enclosure to be constructed even in inclimate weather. Further, infrared or similar heating lamps (not shown) could be employed to dry the upper surface of the walled enclosure or the adhesive which is applied.

A pair of adhesive applicator wipers 396 are also located near the forward end of the housing 388 for applying a suitable adhesive or bonding agent to those portions of the previously deposited turn on the walled enclosure V and the new turn 320 which are to be chemical bonded. Any of a number of aforementioned resins or any of a number of non-commercially available adhesives can be utilized for this purpose. One very effective adhesive or binding agent which has been found to be highly effective for use in the present invention is a conventional epoxy type resin.

The application head 302 includes two pair of tension rollers 397 at its rearward end for rigidly mechanically locking the new turn 320 into rigid alignment with the previous turn on the walled enclosure V. This mechanical locking action is sufficient to hold the two components until a complete setting or polymerization of the bonding agent has taken place. These tension rollers 397 not only create the mechanical locking action which holds the new turn in place, but also effectively serve as braking or retarding rollers. In this case some slight braking force is needed to force the new turn to mechanically lock to the previously applied turn in the walled enclosure. Finally, the housing 388 is provided with vertically disposed rollers 398 which ride along the upper surface of the walled enclosure thus formed and a vertically disposed roller 399 which rides along the upper surface of the new turn, just prior to the application of this new turn to the walled enclosure.

FIGS. 24 through 26 illustrate an additional modified form of system for producing the walled enclosure. FIG. 24 more specifically illustrates a type of pultrusion mechanism designated as P and which includes a resin impregnating member 400 for receiving reinforcing material such as spools or rolls of filament containing strands or tapes from storage racks or creels 402. In like manner, the resin impregnating member 400 also receives web material or mat material often referred to as "fabric" material containing filament reinforcement from rolls or spools 406. These various strands or tapes and fabrics are introduced through a carding plate 408 into the resin impregnating member 400. A resin supply tank 409 may be operatively connected to the resin impregnating member 400 for continuously supplying resin matrix thereto. For this purpose suitable pumping equipment (not shown) would also be provided.

The resin impregnating member 400 again may adopt the form of a resin matrix impregnating dip tank or otherwise, it may adopt the form of a suitable resin matrix impregnating canister of the type mentioned above. In either case, the resin matrix which is contained within the impregnating member 400 is thoroughly impregnated among the various fibers contained within the strand or tape material or the fabric material. Those resin matrix compositions described above and the various reinforcing materials described above are also capable of use in connection with the pultrusion device P.

After the reinforcing material has been impregnated with the resin matrix, the excess resin matrix can be removed by means of a doctor blade or nip rollers (not shown) as may be desired. This impregnated material is then introduced as a bundle into a dielectric energy chamber 410 which is supplied with dielectric energy from a dielectric energy generator 412. In this case, the dielectric energy which is introduced into the chamber 410 is similar to the dielectric energy generated by the dielectric energy curing mechanism described above. Further, the amount of energy which is introduced into the chamber 410 is only sufficient to enable a partial polymerization of the resin matrix which is impregnated into the reinforcing material. In this way, an initiation of a cure is already started and consequently, the amount of energy applied in a final cure which is necessary to completely cure the resin matrix has been substantially reduced.

After the impregnated and partially cured reinforcing material exits the dielectric energy chamber 410, it is introduced into a combination curing and shaping draw-die 414 having a draw-die orifice 416. In this case, the draw-die 414 is similar in construction to the previously described draw-die 286 or for that matter, the previously described draw-die 124 in that the resin matrix impregnated reinforcing material is effectively "pultruded" through the draw-die orifice 416. It should also be observed that the draw-die orifice 416 has a size and shape which is designed to produce an ultimate turn in the walled enclosure, such as the turn 320 described above.

The draw-die 414 is also designed to serve at least the two functions that the draw-die 286 served. In this respect, the draw-die 414 will serve to gather the bundle of impregnated reinforcing material which has been partially cured, and thereafter forms this reinforcing material into the desired cross-sectional shape. In addition, this draw-die 414 will effectively cure the resin or other matrix material impregnated into the reinforcing material during passage through the draw-die orifice 416. For this purpose, the draw-die 414 may again be provided with external heaters or other means to introduce energy into the resin matrix mass (not shown).

This combination of the precuring which occurs in the dielectric energy chamber 410, and the draw-die 414 produces the same augmented type of cure that was present in the apparatus C. However, again it should be recognized that the draw-die 414 could be located within the chamber 410 so that the complete cure could be achieved with dielectric energy within the chamber 410.

The fully cured resin matrix material is pulled through the aforementioned components, such as the resin impregnator 400, and the chamber 410 and the draw-die 414 by means of a pulling mechanism 418 which is substantially identical to the previously described pulling mechanism 290. However, it should also be observed that any form of pulling mechanism could be utilized in the present invention.

The cured and impregnated reinforcing material which has been pultruded, that is, the pultruded stock which has a crosssectional shape and size conforming to a turn in the ultimate walled enclosure, is then stored within a dispensing canister 420. The canister 420 is generally a cylindrical type of container having an outer side wall 422 with horizontally disposed top and bottom walls 424 and which is reinforced at the base by cross beams 426. The top and bottom walls 424 are provided with enlarged central apertures to provide an enlarged central bore 428 communicating with the interior of the canister 420. The pultruded stock is introduced into this walled enclosure through the open top portion and coiled about the interiorly presented surface of the side wall 422, in the manner as illustrated in FIG. 24.

Essentially, the pultruded stock is generated with a high tensile strength and is highly effective in withstanding longitudinal tensional forces applied thereto. In like manner, this form of stock is also highly effective in withstanding longitudinal compression forces applied to the stock. The stock, however, is somewhat yieldable and capable of being coiled through a fairly wide diameter, so that it is capable of being stored within the dispensing container 420. The actual size of the diameter of the coil material is, in this case, normally dependent upon the type of reinforcing material which is used, the cross-sectional size and to some extent, the cross-sectional shape of the reinforcing material.

It can be observed that the pultrusion mechanism P as well as the dispensing canister 420, can be located at a remote site from the actual site of construction during the preparation of the pultruded stock. Actually, the pultruded stock could be generated within a plant or other type of enclosed structure where operating conditions are more ideal, and which also eliminates interference by external atmospheric conditions. During the pultrusion of this raw stock, the stock can be immediately introduced into a plurality of one or more of these dispensing canisters 420. Thereafter, the canisters 420 can be shipped to the site of construction for use in the generation of the walled enclosure.

The pultrusion apparatus P actually forms part of or is used in conjunction with a further modified form of apparatus D which is more fully illustrated in FIGS. 25 and 26 of the drawings. The apparatus D is that portion of the system which is used at the site of construction or fabrication of the walled enclosure, and which uses the canisters 420 containing the pultruded stock.

The apparatus D generally comprises a rotatable supporting carriage 430 which is mounted for rotation about an upstanding king post 432 in the manner as illustrated in FIG. 26 of the drawings. The carriage 430 is provided with a base plate 434 having a cylindrical rail or track-way 436 disposed on its under surface for engaging a plurality of circumferentially spaced support rollers 438. In this case, the support rollers 438 are mounted on brackets 440 which are, in turn, disposed upon the ground or other supporting surface upon which the walled enclosure is to be constructed. The various support rollers 438 which bear against the circular rail 436 are powered by an electric motor 442 or other form of motive power, such as for example, fluid motors or the like. For that matter, it is only necessary to drive one of these rollers 438, although two or more of these rollers could be driven as desired. The base plate 434 is provided at its outer end with an upstanding flange 444 which is sized to engage a lower margin of the cylindrical side wall 422 of the canister 420.

The upstanding king post 432 extends through a central aperture 446 formed within the carriage 430 and the central bore 428 of the dispensing container 420. Furthermore, the king post 432 has the lower end thereof mounted within an upstanding tubular hub 448 and which is, in turn, provided with a stub post 450 driven into the ground or other supporting surface. Again, it should be observed that the king post 432 is located centrally of the walled enclosure to be formed.

A spider structure 452 is also mounted for rotation about the king post 432. This spider structure 452 generally comprises a centrally apertured cylindrical support ring 454 which is concentrically disposed about the king post 432 for vertically shiftable movement therealong, in the manner as illustrated in FIG. 26 of the drawings. The support ring 454 is provided with an enlarged cylindrical mounting flange 456 for carrying a plurality of circumferentially spaced upper and lower brackets 458. These brackets 458, in turn, journal rollers 460, the latter bearing against the exterior surface of the king post 432. The rollers 460 are designed to permit rotatable movement of the support ring 454 about the king post 432. In addition, the rollers 460 are designed so that the support ring 452 can be vertically shiftable upon the king post 432 in a manner to be hereinafter described in more detail.

Mounted on the exterior surface of and extending outwardly of the support ring 454 are a plurality of circumferentially spaced brackets 462 which retain a plurality of radially extending arms 464. Mounted on the outer ends of each of the arms 464 are flange plates 466 for retaining vertically disposed A-frames 468. Each of the A-frames 468 carry horizontally disposed journal plates 470 at their lower ends for mounting a first pair of pintles 472 and a second pair of pintles 474. Mounted on the first pair of pintles 472 for rotatably movement thereabout are guide rollers 476 which are designed to engage the outer surface of the storage vessel V as the spider structure 452 rotates thereabout. Operatively mounted for rotation about the second pair of pintles 474 are guide rollers 478 which are designed to bear against the interior surface of the storage vessel V as the spider structre 452 rotates thereabout.

Mounted on the upper surface of the journal plate 470 is a horizontally disposed pintle 480 which carries a vertically positioned roller 482, in the manner as illustrated in FIG. 26. This vertically disposed roller 482 is designed and located to ride upon the upper surface of the last turn of the walled enclosure during the formation thereof. Consequently, it can be observed that the combination of the two rollers 476 and 478 would engage the exterior surface of the vessel, and the vertically disposed roller 482 which engaged the upper margin of the last turn, provide a supporting movement and a guiding movement for the entire spider structure 452. This, in turn, permits the application head 302 to travel about the walled enclosure with a minimum of variations in movement thereof.

It should be observed that the rollers 476 and 478 would not be completely horizontally disposed since the support ring 454 is also vertically shiftable on the king post 432. However, the spider structure 452 and hence the support ring 454 rotates about the king post 432 in time related movement with respect to the vertically shiftable movement along the king post 432. Consequently, the rollers 476 and 478 are canted slightly with respect to the post 432 to drive the spider structure 452 in a somewhat spiral pattern.

Mounted on one of the radially extending arms 464 is an A-frame 484 which is similar to the A-frame 468 and which carries the application head 302. The application head 302 actually drives the spider structure 452 about the walled enclosure through the drive rollers 390. In a preferred aspect of the present invention, one or more of the other A-frames would be provided with electric motors, such as linear induction motors or other forms of prime movers (not shown) for driving the spider structure 452 about the king post 432. These prime movers would be connected to one or more of the rollers 476 or 478 or 482 for rotating same. Thus, the spider structure 452 could effectively drive itself about the walled enclosure in the way as it is formed. For the purpose of delivering power to the various components on the spider structure or to other components on the apparatus D, the king post 432 may be suitably provided with an electrical slip ring structure (not shown) which cooperates with the support ring 454.

As an alternative structure in accordance with the present invention, the king post 432 could also be rotatable. In this case the king post 432 would be disposed in a hub (not shown) mounted within the ground or other supporting surface and which hub would carry a suitable bearing arrangement to permit rotation of the king post 432. The king post in this arrangement would probably be non-circular in cross section, e.g. rectangular in cross section so that a non-slipping rotatable arrangement would exist between the king post 432 and the support ring 454.

It is possible to provide a horizontally disposed platform 485 or so-called "decking" which extends between two or more of the radially extending arms 464 for carrying various items to be delivered to the application head 302. For example, by reference to FIG. 26, it can be observed that the spider structure 452 may carry a resin tank 486 and a catalyst supply tank 488 and a pumping unit 490 for delivery of these materials to the application head 302. In like manner, a solvent flush pump 492 may also be mounted on the spider structure 452 for rotation therewith. In addition, a motor compressor 494 may also be located on the spider structure 452 for providing necessary air under pressure to various components for operation thereof. In essence, the spider structure could carry effectively all of the components which would be needed for delivery to the application head 302.

The spider structure 452 may also be provided with one or more downwardly struck support rods 496 having a pair of vertically spaced apart rollers 498 to receive a dispensed turn of reinforcing material. In this way the dispensed turn of reinforcing material will be supported prior to its entry into the application head 302.

Mounted on the upper end of the king post 432 is a cap 506 which carries an upstanding pin 508 and journaled about the pin 508 for rotatable movement is a roller 510. Mounted on the roller 510 for rotatable movement about the king post 432 is a post head 512 which carries an outwardly extending bracket 514. Journaled within the bracket 514 is a pulley 516 carrying a lift control cable 518 trained thereabout. It can be observed that this lift control cable 518 may be connected to the spider structure 452 and may also be provided with a counterweight (not shown). In this way, it is possible to permit the vertically shiftable movement of the spider structure 452 and also balancing the weight thereof with the counterweight.

The pin 508 which is fixed with respect to the king post 432 is provided with a plurality of eyelets 520 for retaining guy wires 522. It is generally desirable to use this form of guy wire structure where the outermost ends of these guy wires are fastened to the ground or other supporting surface, beyond the periphery of the walled enclosure in order to maintain rigidity and support for the king post 432.

The application head 302 which is used in the apparatus D is substantially identical to the application head 302 which is used in conjunction with the aforementioned apparatus C. Furthermore, the turn construction which is used in the generation of the walled enclosure by the apparatus C could also be used with the apparatus D.

A starting ring somewhat equivalent to the starting ring 42 may also be employed in order to generate the walled enclosure. In this case, the spider structure 452 would be located at the lowermost position on the king post 432, in the manner as illustrated in FIG. 26. It can be observed that as the size of the walled enclosure increases, the entire spider structure 452 will move upwardly. During the rotation of the spider structure 452 the application head 302 will receive the impregnated and cured reinforcing material stock from the dispensing canister 420. Thus, the dispensing canister 420 will dispense the stock in timed related movement to the movement of the application head 302 about the walled enclosure. Furthermore, the application head 302 will deposite this new turn on a previously deposited turn much in the same manner as was previously described. In this connection, it should again be observed that both a physical and a chemical bonding between the two registered turns will be achieved.

After the tank wall or walled enclosure has been completely generated to the desired height, a spray-up floor equivalent to the floor 184 may be formed. Furthermore, floor seals and the like would also be employed. In like manner, a stiffening ring attachment may also be applied to the upper end of the walled enclosure, in the manner similar to that illustrated in FIGS. 15*a*–15*c*. In this case, the walled enclosure or storage vessel thus formed will be equivalent to the storage vessels of the type illustrated in FIGS. 20 and 21.

Thus, there has been illustrated and described a novel system for fabricating an on-site walled enclosure of reinforced plastic materials without the attendant requirement of substantial forming equipment and manual labor, and which therefore fulfills all of the objects and advantages sought therefore. Many changes, modifications, variations and other uses and applications of the subject system will become apparent to those skilled in the art after considering this specification and the accompanying drawings. All such changes, modifications, variations and other uses and applications which do not depart from the spirit and scope of the invention are deemed to be covered by the invention, which is limited only by the following claims.

Having thus described our invention, what we desire to claim and secure by Letters Patent is:

1. Apparatus for generating a reinforced plastic composite walled enclosure formed of successive turns of spirally wound reinforcing material; said apparatus comprising:

a. a supporting member rotatable through a cylindrical path, b. an application head carried by said supporting member and being movable in a cylindrical path of peripheral length substantially equivalent to the peripheral length of the walled enclosure to be formed, c. delivery means including a canister which contains a substantially fully cured amount of a matrix impregnated fiber containing reinforcing material having a cross-sectional shape substantially equivalent to the shape of a turn in the walled enclosure for delivery to said application head, d. application means operatively associated with said application head for receiving said matrix impregnated reinforcing material to deposit said matrix impregnated reinforcing material as a turn on a previously deposited turn of the spirally wound reinforcing material, e. said application means comprising a draw-die which essentially conforms to the size and shape of a new turn of the impregnated reinforcing material and which die is essentially closed and open on one side thereof, said application means being located so that a previously deposited turn of said walled enclosure substantially closes said draw-die in such size and shape to receive and deposit said impregnated reinforcing material, f. one of said last previously deposited turns and said new turn having an interlockable projection extending therefrom toward the other of said turns and said other of the turns having an interlocking recess formed therein and capable of having said projection mechanically interlocked into said interlocking recess in a zipper type arrangement as said application head moves therealong, g. securement means carried by said application head to rigidly secure and bond said matrix impregnated reinforcing material during deposition thereof as a new turn of said walled enclosure to a previously deposited turn of reinforcing material in said walled enclosure, h. said securement means being provided with bonding means to chemically bond the projection of one of said turns into the interlocking recess of the other of said turns, i. and means on said application head to retentively hold said new turn on said last previously deposited turn of reinforcing material during a portion of the chemically bonding of the projection and the interlocking recess during movement of the application head therealong.

2. The apparatus of claim 1 further characterized in that said supporting member is a structure rotatable about a fixed axis approximating a center of the walled enclosure.

3. The apparatus of claim 1 further characterized in that said supporting member is an upstanding supporting structure which moves around the successive turns of spirally wound reinforcing material through a path having a peripheral length approximately equal to or slightly greater than the peripheral length of said walled enclosure.

4. The apparatus of claim 1 further characterized in that said apparatus comprises a rotatable base plate located within the circumferential periphery of the walled enclosure to be formed, and said supporting member is a boom rotatable with said base plate about a fixed axis approximating a center of the walled enclosure.

5. The apparatus of claim 1 further characterized in that said apparatus comprises a movable carriage member rotatable about the circumferential periphery of the walled enclosure to be formed, and said supporting member is an upstanding supporting shaft carried by and movable with said carriage member.

6. The apparatus of claim 1 further characterized in that said apparatus comprsies a rotatable base plate located within the circumferential periphery of the walled enclosure to be formed, said supporting member is a boom rotatable with said base plate about a fixed axis approximating a center of the walled enclosure, said reinforcing material and an impregnating matrix material are located on said base plate and movable therewith, said impregnating matrix material being located to be contacted by said reinforcing material prior to introduction to said application head.

7. The apparatus of claim 1 further characterized in that said apparatus comprises a movable carriage member rotatable about the circumferential periphery of the walled enclosure to be formed, said supporting member is an upstanding supporting shaft carried by and movable with said carriage member, said reinforcing material and an impregnating matrix material are movable with said carriage member, said matrix material being located to be contacted by said reinforcing material prior to introduction into said application head.

8. The apparatus of claim 1 further characterized in that the cavity in the application head is a draw-die forming orifice which receives uncured matrix impregnated reinforcing material which is uncured and forms the reinforcing material in a desired shape and deposits same as a turn on a previously deposited turn of the spirally wound reinforcing material, and that the application means includes a curing means for applying a curing radiation to the matrix impregnated reinforcing material during deposition thereof to form a cured and rigid turn of reinforcing material.

9. A system for fabricating a generally cylindrical storage structure from fiber containing reinforcing plastic material, said system comprising:

a. a head support member rotatable through a cylindrical path, said head support member being extensible and having an end thereof rotatable through a cylindrical path length substantially equivalent to the cylindrical length of the storage structure to be formed, b. an application head carried by and located on the last named end of said support member and receiving a matrix impregnated fiber containing reinforcing material, c. means operatively associated with support member for moving said support member and application head along previously deposited turns of reinforcing material, d. said application head having a draw-die which essentially conforms to the size and shape of a new turn of impregnated reinforcing material and which draw-die is essentially closed but open on one-side thereof, said application head being located so that a previously deposited turn of said storage structure substantially closes said draw-die in such size and shape to receive and deposit said matrix impregnated reinforcing material as a new turn on a previously deposited turn of the storage structure, e. securement means carried by said application head for rigidly securing and bonding the matrix impregnated reinforcing material as a new turn during deposition thereof to a previously deposited turn of reinforcing material, f. a pair of rollers spaced apart from each other in a plane parallel to the movement of said application head and being located along the exterior surface of the last previously deposited turn of spirally wound reinforcing material, g. a drive belt trained around said pair of rollers and engaging the exterior surface of said last previously deposited turn of spirally wound reinforcing material to drive said application head around said walled enclosure thus formed, h. and motive means carried by said application head to drive one of said rollers and said drive belt.

10. The system of claim 9 further characterized in that a structural foundation member is provided for operative mounting on a support surface to receive the turns of reinforcing material, and which structural foundation member has a cylindrical length substantially equivalent to the cylindrical peripheral length of the storage structure to be formed.

11. The system of claim 9 further characterized in that the matrix impregnated into said reinforcing material is uncured prior to reaching said application head, and said application head forms the impregnated reinforcing material into a desired shape, and a curing means cures the matrix therein during deposition on a previously deposited turn.

12. The system of claim 11 further characterized in that said curing means applies a dielectric curing radiation selected from the class consisting of radio frequency energy and microwave energy to the impregnated reinforcing material.

13. The system of claim 9 further characterized in that said head support member is a hollow tubular member which carries the matrix impregnated reinforcing material therethrough and to said application head.

14. The system of claim 9 further characterized in that additional motive means is provided at the base of said head support member for rotating said support member through said cylindrical path.

15. The system of claim 9 further characterized in that said system also comprises a pultrusion device which pultrudes a substantially fully cured amount of the matrix impregnated reinforcing material having a cross sectional shape substantially equivalent to the shape of a turn in the walled enclosure, and a canister sized so that the pultruded reinforcing material which is fully cured is introduced into a canister and which canister is located within the area of the storage structure to dispense the fully cured reinforcing material to the application head.

16. A system for fabricating a generally cylindrical storage structure from fiber containing reinforcing plastic material at an on-site location, said system comprising:

a. means at said on-site location for pultruding a continuous length of substantially fully cured matrix impregnated fiber containing reinforcing material having a size and shape conforming to a layer turn in the storage structure.

b. storage means at said on-site location for retaining a coiled portion of the continuous length of the substantially fully cured matrix impregnated reinforcing material, c. a head support member rotatable through a cylindrical path, and having an end thereof rotatable through a cylindrical path length substantially equivalent to the cylindrical length of the storage structure to be formed, d. an application head carried by and located on the last named end of said support member for receiving the matrix impregnated fiber containing reinforcing material from said storage means, e. means for moving said support member and application head along previously deposited turns of reinforcing material and depositing the substantially fully cured reinforcing material as a new turn on the last previously deposited turn of reinforcing material, f. one of said last previously deposited turns and said new turn having an interlockable projection extending therefrom toward the other of said turns and said other of the turns having an interlocking recess formed therein and capable of having said projection mechanically interlocked into said interlocking recess in a zipper type arrangement as said application head moves therealong, g. means on said application for chemically bonding the projection on either new turn of the substantially fully cured matrix impregnated reinforcing material or the last previously deposited turn to the interlocking recess on the other of said turns to thereby bond said new layer turn to said last previously deposited turn of reinforcing material, h. and means on said application head to retentively hold said new turn on said last previously deposited turn of reinforcing material during a portion of the chemically bonding of the projection and the interlocking recess during movement of the application head therealong.

17. The system of claim 16 further characterized in that the means for forming the continuous length of material comprises:

a. means for impregnating a fiber containing reinforcing material with a curable matrix, b. means for pulling the matrix impregnated reinforcing material through a draw-die orifice to provide a size and shape to said impregnated reinforcing material substantially equivalent to a layer turn in the storage structure, c. means for substantially fully curing the reinforcing material pulled through said draw-die orifice.

18. The system of claim 16 further characterized in that a structural foundation member is provided for operative mounting on a support surface to receive the turns of reinforcing material, and which structural foundation member has a cylindrical length substantially equivalent to the cylindrical peripheral length of the storage structure to be formed.

19. The system of claim 16 further characterized in that motive means is provided on said application head for driving said head along the previously deposited turns of reinforcing material.

20. The system of claim 16 further characterized in that motive means is provided on said application head for driving said head along the previously cured and deposited turns of reinforcing material, and additional motive means is provided for rotating said support member through said cylindrical path.

21. A system for fabricating a generally cylindrical storage structure from fiber containing reinforcing plastic material at an on-site location, said system comprising:

a. means for providing a continuous length of substantially fully cured matrix impregnated fiber containing reinforcing material having a size and shape conforming to a layer turn in the storage structure, b. storage means at said on-site location for retaining a coiled portion of the continuous length of the substantially fully cured matrix impregnated reinforcing material, and which length of reinforcing material has a cross-sectional size and shape substantially equivalent to previously deposited turns of reinforcing material on the storage structure, c. platform means located in relationship to said storage means and vertically rising as the height of the storage structure increases during fabrication thereof, d. a head support member operatively associated with said platform means and being rotatable through a cylindrical path, and said head support member having an end thereof rotatable through a cylindrical path length substantially equivalent to the cylindrical length of the storage structure to be formed, e. an application head carried by and located on the last named end of said support member for receiving the matrix impregnated fiber containing reinforcing material dispensed from said storage means, f. means for moving said support member and application head along previously deposited turns of reinforcing material and depositing the substantially fully cured reinforcing material as a new turn of reinforcing material on the last previously deposited turn, g. one of said previously deposited turns and said new turn having an interlockable tongue-like projection extending therefrom toward the other of said turns and said other of the turns having an interlocking groove-like recess formed therein and capable of having said projection mechanically interlocked into said interlocking recess in a zipper type arrangement as said application head moves therealong, h. means on said application head for chemically bonding the projection of one of said new turn of substantially fully cured matrix impregnated reinforcing material or the last previously deposited turn to the interlocking recess on the other of said turns to thereby bond said new layer turn to said last previously deposited turn of reinforcing material, i. and means on said application head to retentively hold said new turn on said last previously deposited turn of reinforcing material during a portion of the chemical bonding of the projection and the interlocking recess during movement of the application head therealong.

22. A system for fabricating a generally cylindrical storage structure from fiber containing reinforcing plastic material at an on-site location, said system comprising:

a. means for providing a continuous length of substantially fully cured matrix impregnated fiber containing reinforcing material having a size and shape conforming to a layer turn in the storage structure, b. storage means at said on-site location for retaining a coiled portion of the continuous length of the substantially fully cured matrix impregnated reinforcing material, c. a head support member rotatable through a cylindrical path, and having an end thereof rotatable through a cylindrical path length substantially equivalent to the cylindrical length of the storage structure to be formed, d. an application head carried by and located on the last named end of said support member for receiving the matrix impregnated fiber containing reinforcing material from said storage means, e. means for moving said support member and application head along previously deposited turns of reinforcing material and depositing the substantially fully cured reinforcing material as a new turn on the last previously deposited turn of reinforcing material, f. said application means comprising a draw-die which essentially conforms to the size and shape of a new turn of the impregnated reinforcing material and which die is essentially closed and open on one side thereof, said application means being located so that a previously deposited turn of said walled enclosure substantially closes said draw-die in such size and shape to receive and deposit said impregnated reinforcing material, g. each turn of the matrix impregnated reinforcing material having a projection extending therefrom and a projection receiving groove thereon and on each previously deposited turn of the spirally wound reinforcing material so that a projection of one of said turns extends into and is mechanically interlocked in the projection receiving groove of the other of said turns in a zipper type arrangement as said application head moves therealong, h. means on said application head for chemically bonding the new turn of the substantially fully cured matrix impregnated reinforcing material as a new layer turn to a previously deposited turn of reinforcing material, i. and means on said application head to retentively hold said new turn on said last previously deposited turn of reinforcing material during a portion of the chemical bonding of the projection and the projection receiving groove during movement of the application head therealong.

23. Apparatus for generating a reinforced plastic composite walled enclosure formed of successive turns of spirally wound reinforcing material; said apparatus comprising:

a. a supporting member rotatable through a cylindrical path, b. an application head carried by said supporting member and being movable in a cylindrical path of peripheral length substantially equivalent to the peripheral length of the walled enclosure to be formed, c. delivery means to supply a pultruded matrix impregnated fiber containing reinforcing material to said application head in the form of a turn to be used on the walled enclosure and having the desired cross-sectional size and shape, d. application means operatively associated with said application head for receiving said turn of matrix impregnated reinforcing material to deposit said turn of matrix impregnated reinforcing material as a new turn on a previously deposited turn of the spirally wound reinforcing material, e. said delivery means supplying said application head with a sufficient amount of the reinforcing material in the form of a turn in a continuous strip to form a plurality of turns on the walled enclosure, f. said application means comprising a draw-die which essentially conforms to the size and shape of a new turn of the impregnated reinforcing material and which die is essentially closed and open on one side thereof, said application means being located so that a previously deposited turn of said walled enclosure substantially closes said draw-die in such size and shape to receive and deposit said impregnated reinforcing material, g. one of said last previously deposited turn and said new turn having an interlockable projection extending therefrom toward the other of said turns and said other of the turns having an interlocking recess formed therein and capable of having said projection mechanically interlocked into said interlocking recess in a zipper type arrangement as said application head moves therealong, h. securement means carried by said application head to rigidly secure and bond said matrix impregnated reinforcing material during deposition thereof as a new turn of said walled enclosure to a previously deposited turn of reinforcing material in said walled enclosure, i. said securement means being provided with bonding means to chemically bond the projection of one of said turns into the interlocking recess of the other of said turns, j. and means on said application head to retentively hold said new turn on said last previously deposited turn of reinforcing material during a portion of the chemical bonding of the projection and the interlocking recess during movement of the application head therealong.

24. Apparatus for generating a reinforced plastic composite walled enclosure formed of successive turns of spirally wound reinforcing material; said apparatus comprising:

a. a supporting member rotatable through a cylindrical path, b. an application head carried by said supporting member and being movable in a cylindrical path of peripheral length substantially equivalent to the peripheral length of the walled enclosure to be formed, c. delivery means including a pultrusion device which pultrudes a substantially fully cured amount of a matrix impregnated fiber containing reinforcing material having a cross-sectional shape substantially equivalent to the shape of a turn in the walled enclosure for delivery to said application head, d. application means operatively associated with said application head for receiving said matrix impregnated reinforcing material to deposit said matrix impregnated reinforcing material as a turn on a previously deposited turn of the spirally wound reinforcing material, e. said application means comprising a draw-die which essentially conforms to the size and shape of a new turn of the impregnated reinforcing material and which die is essentially closed and open on one side thereof, said application means being located so that a previously deposited turn of said walled enclosure substantially closes said draw-die in such size and shape to receive and deposit said impregnated reinforcing material, f. one of said last previously deposited turns and said new turn having an interlockable projection extending therefrom toward the other of said turns and said other of the turns having an interlocking recess formed therein and capable of having said projection mechanically interlocked into said interlocking recess in a zipper type arrangement as said application head moves therealong, g. securement means carried by said application head to rigidly secure and bond said matrix impregnated reinforcing material during deposition thereof as a new turn of said walled enclosure to a previously deposited turn of reinforcing material in said walled enclosure, h. said securement means being provided with bonding means to chemically bond the projection of one of said turns into the interlocking recess of the other of said turns, i. and means on said application head to retentively hold said new turn on said last previously deposited turn of reinforcing material during a portion of the chemically bonding of the projection and the interlocking recess during movement of the application head therealong.

25. The apparatus of claim 24 further characterized in that the pultrusion device is located within the walled enclosure and rotates with the application head.

26. The apparatus of claim 24 further characterized in that the apparatus comprises a canister sized so that the pultruded reinforcing material which is fully cured is introduced into the canister and which canister is located within the area of the walled enclosure to dispense the fully cured reinforcing material to the application head.

* * * * *